US007988520B2

(12) United States Patent
Faanes

(10) Patent No.: US 7,988,520 B2
(45) **Date of Patent: *Aug. 2, 2011**

(54) SCULPTURE DEVICE

(75) Inventor: Perry C. Faanes, Capistrano Beach, CA (US)

(73) Assignee: Perry Faanes, Capistrano Beach, CA (US)

( * ) Notice: Subject to any disclaimer, the term of this patent is extended or adjusted under 35 U.S.C. 154(b) by 92 days.

This patent is subject to a terminal disclaimer.

(21) Appl. No.: 12/505,482

(22) Filed: Jul. 18, 2009

(65) Prior Publication Data

US 2009/0280272 A1 Nov. 12, 2009

Related U.S. Application Data

(63) Continuation-in-part of application No. 11/424,422, filed on Jun. 15, 2006, now Pat. No. 7,578,719, which is a continuation-in-part of application No. 10/781,587, filed on Feb. 17, 2004, now abandoned.

(60) Provisional application No. 60/450,342, filed on Feb. 28, 2003.

(51) Int. Cl.
*A63H 33/22* (2006.01)
*A63H 33/00* (2006.01)

(52) U.S. Cl. ..... 446/219; 446/129; 446/139; 472/61

(58) Field of Classification Search ..... 446/129, 446/139, 219, 92, 288; 472/61, 63; 40/427, 40/453

See application file for complete search history.

(56) References Cited

U.S. PATENT DOCUMENTS

| | | | | | |
|---|---|---|---|---|---|
| 2,452,363 | A | * | 10/1948 | Flotron | 359/616 |
| 2,484,116 | A | | 10/1949 | Papke | |
| 3,124,896 | A | * | 3/1964 | Cook | 446/84 |
| 3,244,468 | A | | 4/1966 | Meltzer | |
| 4,120,116 | A | | 10/1978 | Williams | |
| 4,192,580 | A | | 3/1980 | Meyer | |
| 5,013,278 | A | | 5/1991 | Dixon | |
| 5,407,391 | A | | 4/1995 | Monroe | |
| 5,542,870 | A | | 8/1996 | Westersund | |
| 5,707,237 | A | | 1/1998 | Takemoto | |
| D390,612 | S | * | 2/1998 | Brakefield | D21/398 |
| 5,848,029 | A | | 12/1998 | Chang | |
| 6,131,318 | A | | 10/2000 | Hsieh | |
| 6,383,429 | B1 | | 5/2002 | Noto | |
| 2007/0197126 | A1 | | 8/2007 | Derrah | |

* cited by examiner

*Primary Examiner* — Kien T Nguyen

(57) ABSTRACT

A sculpture device may comprise a base, at least one figure, a cover and a control element. The base may have upper and lower surfaces. The figure may be movable along the upper surface. The cover may be coupled to the base and may have a lens mounted therein to which an operator may view the figure. The control element may include a magnetic mechanism for magnetically attracting the figure such that movement of the control element along the lower surface causes corresponding movement of the figure along the upper surface.

20 Claims, 14 Drawing Sheets

SCULPTURE DEVICE

CROSS-REFERENCE TO RELATED APPLICATIONS

This is a continuation-in-part application of Ser. No. 11/424,422, entitled SCULPTURE METHOD UTILIZING NEW MEANS OF SIMULATING, VIEWING, AND DISPLAYING SPORTING, UNDERSEA AND OTHER ENVIRONMENTS and filed Jun. 15, 2006, which is a continuation-in-part application of Ser. No. 10/781,587, entitled SCULPTURE METHOD UTILIZING NEW MEANS OF SIMULATING, VIEWING, AND DISPLAYING SPORTING, UNDERSEA AND OTHER ENVIRONMENTS, filed Feb. 17, 2004 that claims priority to Ser. No. 60/450,342 entitled SCULPTURE METHOD UTILIZING NEW MEANS OF SIMULATING, VIEWING, AND DISPLAYING SPORTING, UNDERSEA AND OTHER ENVIRONMENTS, filed Feb. 28, 2003, the entire contents of each application being incorporated by reference herein.

STATEMENT RE: FEDERALLY SPONSORED RESEARCH/DEVELOPMENT (Not Applicable)

BACKGROUND

This invention is directed toward a sculpture, and the method of making the sculpture, utilizing a mold and manufacturing method in which the underside of the mold mimics the top of an ocean bottom, or other underwater environment, which can be painted to realistically depict different types of corals and fishes.

This ocean bottom can be seen through clear, smooth-surfaced sections of the front, sides, and back of the sculpture, thereby creating an "aquarium view" of the ocean bottom. The invention also contains a fish-eye lens, which can be moved in several directions, thereby affording a user numerous views of the surfer, wave, and ocean bottom from different perspectives, or of other aquatic sportspeople engaging in various aquatic sports. The fish-eye lens can be mounted above the water, or at the waterline, thereby affording a view of environments and actions both above and below the waterline.

Sculpture has been a popular art form since around 30,000 B.C., which is the approximate date that the earliest sculptures found were created. While the early Germanic peoples who created these sculptures have been credited as the earliest "sculptors", there is another line of reasoning which holds that sculpture is an art form that should really go back to the earliest wooden clubs. In any case, sculpture has been an accepted form of re-creating objects and making artistic statements for much of human history.

Over the years, sculpture has evolved from basic wooden carvings and clay molding to active manipulation of a variety of media. Three dimensional sculpture aimed toward faithfully re-creating a scene has become one of the more popular forms of sculpture, with a number of recreations, whether miniature or full size, of famous landmarks and scenes from human experience providing entertainment and profit to locations ranging from prestigious art galleries and museums to tacky gift shops and souvenir stands.

Re-creating ocean and other water environments has been a goal of many artists who enjoy aquatic sports and the unique environment of the locales in which aquatic sports take place. There have been numerous attempts to portray three dimensional aquatic environments as a way to allow people to "experience" what is otherwise a fairly hostile environment. Many of these attempts have aimed toward allowing a landbased human to see what an aquatic environment really looks like—the most common example of this is the common aquarium, which allows a viewer to see how fish and other aquatic animals swim, eat, and reproduce. To date, however, there has not been invented a device which accurately depicts the sport of surfing, and other aquatic sports, so that a non-surfer can visualize how the various components of surfing—the surfer, the surfboard, the wave, and the ocean bottom—all interrelate to result in the exhilaration of a surfing ride. The present invention addresses this need.

The invention has a number of possible iterations, but we shall use the sport of surfing as an example to illustrate the various aspects of the invention, as it is the best mode of this invention.

It would be useful to describe some basic terminology relating to ocean waves and surfing in general so that a reader has adequate knowledge to appreciate and practice the invention. The vast majority of the waves used by surfers for surfing are created by wind blowing over the ocean's surface. The size of the wave depends upon the velocity of the wind, the amount of time the wind blows, and the fetch, or the size of the area over which the wind blows. As the waves move toward a shallow ocean bottom (usually found near the coastline, with some notable exceptions such as the Cortes Bank, which is a submerged reef over a hundred miles off the California coast), the waves become more steep. When the water is approximately one and one halftimes deeper than the wave is tall, the wave begins to break. If the ocean bottom gradually becomes shallower—such as occurs with some of the gently sloping sandbars off the California coastline—the wave will gently spill over, creating a weakly breaking wave which is ideal for beginners. In areas where the ocean bottom rises more abruptly—such as the coral reefs of Hawaii and other tropical locations—the waves break with much more force, and the top of the wave races over the bottom of the wave, resulting in a "top to bottom" break which frequently pitches out so far and so quickly that it creates a hollow cylinder of air inside the wave, which is called the tube.

No matter how the wave breaks, all waves have a front face, which is the part of the wave which faces the beach, and a back face, which faces out to sea. A person standing on the beach will always see the front face; a boat out beyond the breakers will always see the back face. A surfer (or surf photographer) to the side of a breaking wave can get a view sideways down the wave "down the line", such that he/she can see a surfer inside of the tube. This is considered one of the optimum views of a surfer in action. Another very popular view of the surfer is an underwater view, taken usually by a surf photographer who has positioned himself/herself such that the wave rolls over his/her head with a surfer only a few feet away, allowing a shot from underwater which shows the silhouette or shadow of the surfer against the texture of the front face of the wave.

The object of surfing is to position the surfboard either in the tube or directly in front of the breaking portion of the wave, an area known as the "pocket" of the wave, which contains the most energy and allows for the most explosive and radical maneuvers. A skilled surfer performs a variety of maneuvers designed to keep the surfboard around the pocket, including stalls, cutbacks, 360's, rollercoasters, and bottom turns. It is the profession of the surf photographer to capture these maneuvers and record them for the enjoyment of the general public in the form of magazine pictures and surf movies. While there have been attempts to capture the beauty, thrills, and inherent danger in the sport of surfing in three-dimensional form, prior to this invention such attempts have failed to adequately portray the surfing environment as a whole. The present invention meets this long-felt need by faithfully replicating the surfing environment—including the wave form, the act of surfing the wave, and the underwater environment beneath the wave—in a means which is both eye-pleasing and readily lends itself to mass production via molds. The invention has a number of components which will be discussed below.

A major part of the invention is the use of a clear, transparent backsides and sides to the wave, and a clear front portion of the wave, such that a person can view the back, sides, and front of the sculpture and see through the wave. This provides two unique and attractive views which prior to this invention were not utilized. First, a viewer can see the texture of the wave face on the front of the wave. As illustrated by the figure, the wave face of these sculptures is textured in a manner such that it appears similar to the wind-whipped face of an actual ocean wave. The transparent resin or plastic from which the sculpture is created allows a viewer to see a vague silhouette or shadow of the surfer through the textured face of the wave. This type of view was popularized in the surf movie Free Ride, which was one of the pivotal surf films of the late 1970's. Free Ride was the first surf movie to make extensive use of the underwater perspective in shooting surfers as then traversed the wave faces. The present invention represents the first attempt to capture this perspective in a sculpture of the sport of surfing.

The second unique view the clear wave back provides is in allowing a viewer to see an artist's rendition of the ocean bottom and its flora and fauna at a particular geographic location. Due to the differences in water temperature at different latitudes, ocean currents, sedimentary deposition sources such as rivers, and other variables, the ocean bottom upon which waves break, along with the associated fish, invertebrates, and marine algae and plants varies dramatically throughout the world. The present invention captures these different ocean bottoms, ranging from the jagged coral reefs and colorful fishes of Hawaii to the sand bottoms, eelgrass, bat rays and sharks found in many California surf spots. The equipment used by the surfer will also vary with the wave conditions. For example, the surfer on the small wave in Southern California surfs a "cruiser" long board and wears surf trunks, the Hawaiian surfer needs a tri-fin thruster and strong surf leash to handle the powerful reef surf found in the Islands, while the Northern California surfer wears a wetsuit, booties, and a hood for protection against the cold waters.

In another aspect of the invention at least one figure configured as an actor in the scene is movably positioned on the base. The figure is maintained in position on the surface of the base member by magnetic attraction between magnetic or magnetically attracted material on the lower surface of the support base of the figure and a magnetic control element on the exterior surface of the base member.

Another major part of this invention is the method by which the ocean bottoms are created. Artists such a Wyland and Lassen have captured the beauty of the different underwater scenes in their two-dimensional paintings and murals, but prior to this invention there has not been a sculpture which recreates a three-dimensional view of the underwater environment. The method of recreating the underwater scene is an essential part of this invention as it utilizes a potentially far-ranging process which lends itself readily to mass production, and is not limited to merely faithfully re-creating ocean bottoms. Rather, this method has clear applicability to rivers, swimming pools, diving pools, undersea SCUBA diving environments, and even miniatures of famous waterfronts throughout the world.

To recreate an ocean bottom, the invention relies upon an artist to make a clay mold of an ocean bottom environment using traditional potter's tools along with dremels and other motorized devices. Each item in the ocean bottom, including the substrate, corals, fish, algae, plants, and other unique characteristics of each sculpture's environment are individually handcrafted into the clay mold, along with the shapes of the wave and surfer. The clay mold, when finished, is then used as the sample from which a metal mold is created.

After the metal mold is formed, mass production of the sculpture is commenced. After each sculpture is finished, a painter applies a variety of paints to the underside of the sculpture so that each indentation is painted in realistic colors and tones to mimic its real life counterpart. The finished result is such that a viewer sees the ocean bottom and its associated flora and fauna from an "aquarium view", which realistically depicts a number of different ocean/surf environments in a manner which allows a viewer to feel that he/she is a part of the environment.

The invention as it relates to the sport of surfing has two basic iterations, both of which are readily adaptable to the further sports, hobbies, and landmarks discussed later in this patent. First, the sculpture can be designed for viewing solely as a three-dimensional sculpture, with attractive views offered on all four sides. From the direct front of the sculpture, the viewer will see a normal view that a beachgoer would see as he/she looked out into the waves. The two end views would simulate a "surfer's view" which would be seen by another surfer paddling out through the waves looking "down the line" into a wave being surfed by another surfer. The back view would be the aforementioned "aquarium view" through the back of the wave which encompasses both the textured face of the wave and the surfer silhouette on the other side of the textured face, and the locale-specific ocean bottom.

A second iteration of the surfing sculpture involves the use of a "fisheye" viewer which is enclosed in a circular cavity molded into the sculpture. The viewer allows a user of the invention to view the surfer from inside the "tube", which is a cylindrically hollow wave caused by the wave breaking over a rapidly rising ocean bottom, whereupon the top portion of the wave "pitches out" and creates a hollow cylinder through which a skilled surfer can ride his/her surfboard. The eyepiece can be either fixed or moveable. With the fixed eyepiece, the only view a user has is of the wave tubing over the head of the surfer. With the moveable eyepiece, a user can view the surfer from different angles, as well as directing the eyepiece down toward the ocean bottom, allowing for an attractive view of the sand, coral, sponges, algae, seaweeds and fishes found on ocean bottom ("algae" are aquatic plants such as kelp which reproduce without the seeds found in real plants, sexually reproducing marine plants are generally called "seaweeds").

The "fish-eye" viewer has further applications to "split-level" views of the air/water interface. Since many water sports take place at least partially on the surface of the water, the invention can be used to simulate the view an ocean sport enthusiast will get when he/she is looking above and below the waterline. For sports such as surfing, snorkeling, fishing, and kayaking, the surface of the ocean or river bottom over which the sport or hobby takes place is as important as what is happening on the surface of the water, both in terms of the beauty of the underwater environment and because the wave action is directly tied to the bottom configuration of the ocean or river bottom over which the action is taking place.

The invention also lends itself to a number of additional sports and hobbies—the sport of surfing was used here merely as an example. Among the other water sports which are captured in three-dimensional form by this invention are SCUBA diving, kayaking (river kayaking, sea kayaking, and surf kayaking), river rafting, boogie boarding, fishing (lake, stream, and saltwater), body surfing, snorkeling, boating, and water skiing. In all these sports there is either a unique underwater view found in the sport which can be successfully recreated using the methods and techniques of this invention or/and there is some element of speed or other movement which lends itself to simulation through the use of an eyepiece viewer. Non-water sports related applications include car racing, track and field events, skydiving, team sports such as football, baseball, basketball and hockey, and outdoor sports such as skiing, snowboarding, rock/mountain climbing, and hiking.

The invention can also be used as a method of replicating means of transportation and famous landmarks, including those found in the water (such as oil derricks, submarines, deep sea submersibles), those found on the air/water interface (Golden Gate Bridge, famous ocean-, river-, or lakefront towns such as New York, Chicago, Los Angeles, Hong Kong and Honolulu, and waterfront landmarks such as the Hotel Del Coronado, and those found on land such as famous ski resorts like Vail and Aspen.

A further use of the invention is to recreate scenes involving animals and plants, particular those found in water and on the air/water interface. Scenes such as bears trying to catch salmon, whales coming up for air, a shark chasing a large tuna, and pelicans swooping down to catch fish all lend themselves readily to being illustrated in attractive three-dimensional representation by this invention.

There are numerous examples in the prior art of Sculpture methods. For example, U.S. Pat. No. 6,383,429 by Noto teaches a method of making a Sculpture which, like the present invention, suggests the use of resin to make the molded object, but Noto's method calls for embedding one such resin object within another. It does not discuss the idea of molding an undersea or other environment into the back of the resin object, nor allowing for the undersea environment to be painted to resemble coral or other underwater environments, nor does it allow for an eyeglass viewer to allow a user to "zoom in" and "zoom out" to take different views of the object.

Further objects and features of this invention will be apparent to one skilled in the art. It will be readily apparent to those skilled in the art that still further changes and modifications in the actual concepts described herein can readily be made without departing from the spirit and scope of the invention as defined by the description of this invention. It is particularly stressed that this invention is readily applicable to a number of different sports, as well as famous landmarks—both natural and human-made, and that the surf sculpture example illustrated here is not in any way meant to limit the scope of this patent.

BRIEF SUMMARY

This invention is directed toward a sculpture, and the method of making the sculpture, utilizing several unique methods of simulating, viewing, and displaying sporting, undersea and other environments. It is an object of this invention that a sculpture can be created by making a mold such that the underside of the mold mimics the top of an ocean bottom, or other aquatic bottom;

It is a further object of this invention that the "ocean bottom" can be painted in different colors which realistically depict different types of corals, fishes and other undersea plants, algae, and animals found. in the particular environment the artist is trying to recreate.

It is a further object of this invention that the "ocean bottom" can be seen through clear, smooth-surfaced sections of the front, sides, and back of the sculpture, thereby creating an "aquarium view" of the ocean bottom.

It is a further object of this invention that a user can view the surfer or other aquatic sportsperson through the back of the wave and see a silhouette or shadow view of the surfer as he/she traverses the wave.

It is a further object of this invention that the user be able to get a view from inside the "tube" of the wave of a rider who is surfing out of the tube away from the viewer through the use of a "fish-eye" lens.

It is a further object of this invention that, through manipulating the "fish-eye" lens, the viewer can zoom in, zoom out, and maneuver the lens to change his/her perspective on the surfer, the wave, and the ocean bottom.

It is a further object of this invention that the "fish-eye" lens can be located at the water level, thereby affording a viewer views of both above and below the waterline.

It is a further object of this invention to provide a sculpture in which at least one figure depicted in the sculpture is movable.

In a further embodiment, the disclosed embodiments comprise a sculptured device including a base, at least one figure, a cover and a control element. The base may have upper and lower surfaces. The figure may be movable along the upper surface. The cover may be coupled to the base and may have at least one lens such as, without limitation, a magnifying lens or a wide angle lens mounted to the cover and through which an observer or an operator of the sculpture device may view the figure. The operator may also view a scene which may be represented by the upper surface or by any portion of the sculpture device. In this regard, the sculpture device may depict the scene for an activity that may be carried out at the scene. The lens may provide a means by which an operator may view the figure and the scene during movement of the figure along the upper surface and/or when the figure is stationary.

The sculpture device may further include the control element which may have a magnetic mechanism for magnetically attracting the figure and causing the figure to be retained against the upper surface. The magnetic mechanism may provide a means by which the figure may be retained against the upper surface in a position that is opposite of the position of the control element on the lower surface. In this regard, the control element is movable along the lower surface and is configured such that movement thereof causes corresponding movement of the figure to a corresponding position on the upper surface. Such movement of the figure may be viewable by an observer or operator looking through the lens and viewing the figure and the scene represented by the upper surface.

The features, functions and advantages that have been discussed can be achieved independently in various embodiments of the present disclosure or may be combined in yet other embodiments, further details of which can be seen with reference to the following description and drawings below.

DETAILED DESCRIPTION

The present invention relates to a miniature diorama scene that includes a viewing device which allows an observer to view the diorama as though he were present in the scene and further permits the observer to move a figure in the scene even while he is observing. The figures are sculpted to be consistent with the scene. Thus for a surfing scene, the figure is sculpted as an individual riding a surfboard or in the case of a skiing scene, as a skier. The diorama may contain a single figure or multiple figures such as would be the case for a scene representing a baseball stadium or football stadium that may include some or all of the players that involved in the game.

More particularly the invention comprises a base member having at least an upper surface which is configured to represent the particular scene for the diorama. The base is adapted for receiving an optical viewer that includes a wide-angle lens that permits an observer to view the scene as though he were actually in it. At least one figure configured as an actor in the scene is movably positioned on the base. The figure is maintained in position on the surface of the base member by magnetic attraction between magnetic or magnetically attracted material on the lower surface of the support base of the figure and a magnetic control element on the exterior surface of the base member. Movement of the control element along the exterior surface of the base member produces movement of the figure due to magnetic attraction between the support member of the figure and the control element. It will be understood that a similar result is achieved when the support base of the figure includes magnetic material and the control element includes magnetically attracted material. The invention also contains a fish-eye lens, which can be moved in several directions, thereby affording a user numerous views of the surfer, wave, and ocean bottom from different perspectives.

Figure 1:
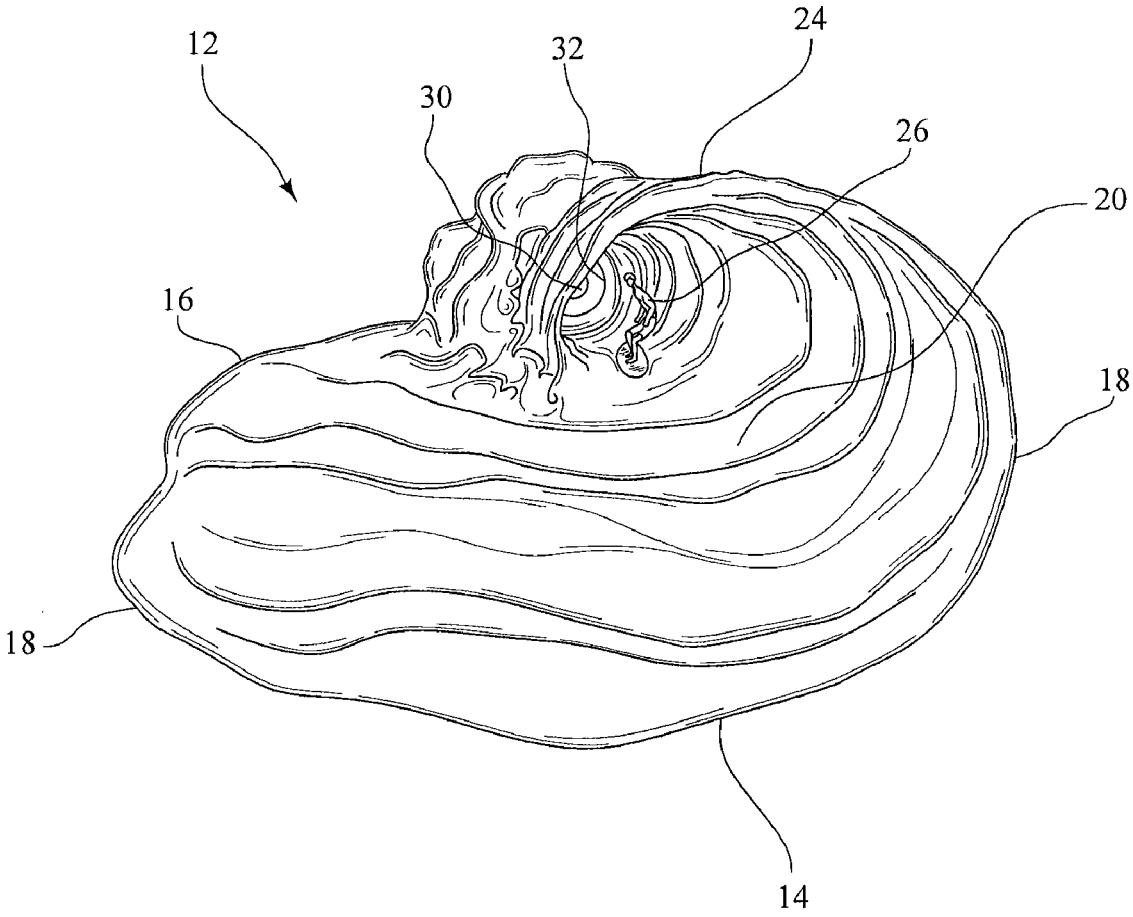
FIG. 1 is an end view of an embodiment of the present invention representing a curling wave scene and surfer as viewed from the front end of the base.

Referring to FIG. 1, the invention is depicted as a surfing setting comprising a base 12 having front, rear, and side faces 14, 16 and 18 respectively and an upper surface 20 and a bottom surface 22. As illustrated the upper surface 20 and one side face 18 are sculpted as a wave having a portion 24 of the side face 18 adjacent the rear face 16 extended above the upper surface 20 and folded over the upper surface 20 to form a cylinder, the bore of which extends from the rear face 18 and opens to the upper surface 20. Portion 24 is configured to represent the curling area of a wave as will be found with larger incoming waves that are highly desired by surfers.

The base 12 is preferably formed by casting a resin material into the desired configuration. For example, the resin may be a castable thermoplastic, epoxy, polyester isophthalic-polyester resin or the like and may be transparent, translucent or opaque. A dye may be incorporated in the resin to impart a desired color to the base 12 to improve the appearance of the scene. For example the base 12 in this illustration is typically blue or green to represent water while the curled portion may include strips of white opaque resin to represent the foam on the upper portion of a curling wave. For other types of scenes, such as for example a downhill skiing scene, an opaque white base 12 is preferred.

Casting temperature and curing conditions are dependent upon the amount of catalyst, the type of resin, the thickness of the casting, the temperature of resin and of the casting room, and the amount of dye compounded in the resin. These factors are well understood in the art.

As illustrated, a figure 26, generally scaled to size to fit the scene, represents a surfer riding the wave. That figure 26, shown in more detail in FIG. 4, includes the form of an individual and a surfboard. The lower surface of the surfboard serves as a support for the figure 26 and further includes a strip 38 of magnetic or magnetically attractable material for retaining the figure 26 on the upper surface 20 of the base 12 by a magnetic field created by a control element 27 which comprises a pair of magnets 28 located on an exterior surface of the base 12 opposite the lower surface of the surfboard.

Figure 3:
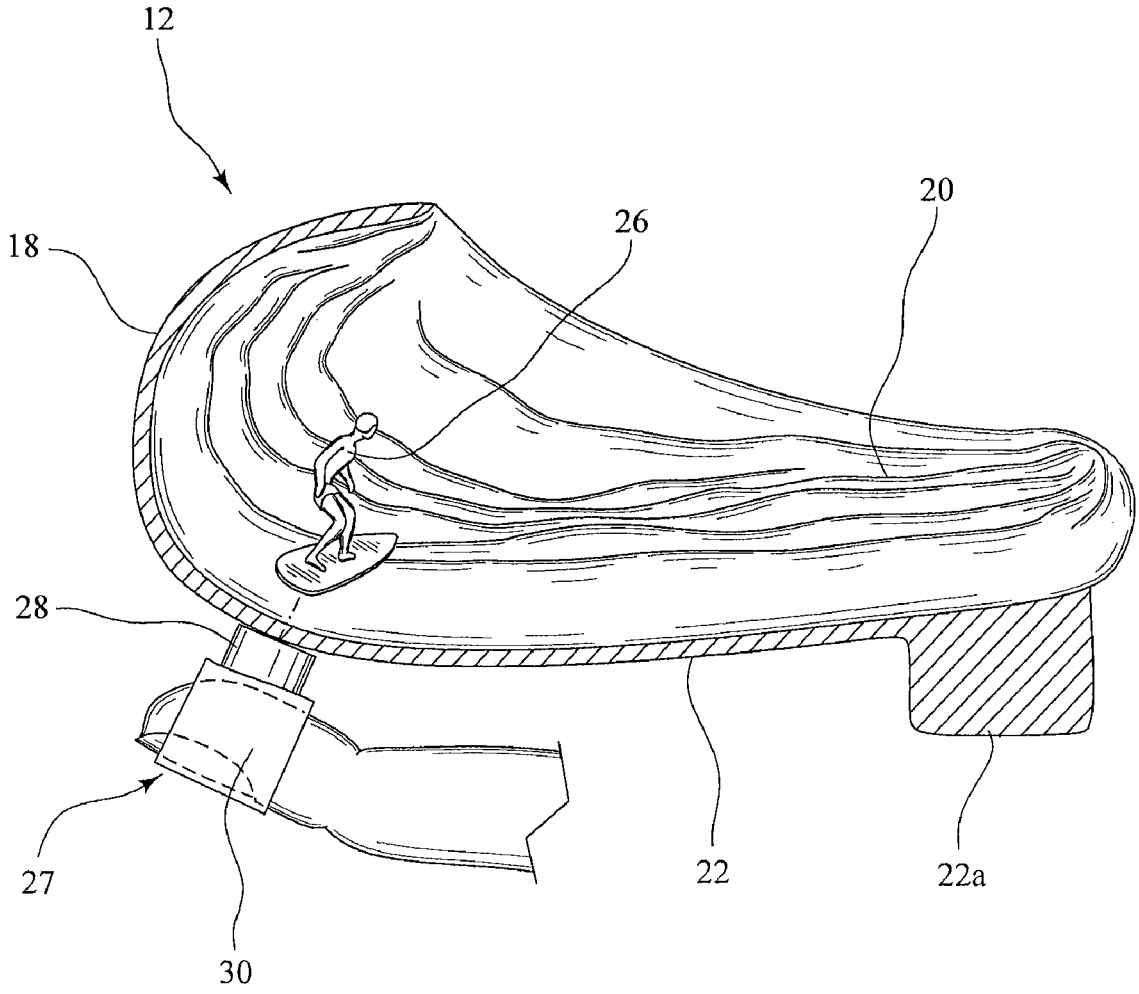
FIG. 3 is a sectional view of the embodiment of the invention shown in FIG. 1 illustrating one way of moving the figure.

As shown in FIG. 3, the magnets 28 of the control element 27 are adapted for being moved by the user's finger. As the magnets 28 are moved in a sliding fashion over the exterior surface of the base 12 the figure 26, by virtue of the magnetic field between the magnet 28 and the strip 38 of material on the lower surface of the surfboard, simultaneously moves to a position corresponding to the position of the magnets. In this manner the user can use the control element 27 to move the figure 26 to desired positions in the curl of the wave or on the upper surface 20 of the base to change the view. The outer faces of the magnets 28 opposite the side in contact with the base 12 are adapted to be moved by the user's finger, such as having an indented portion on the outer face of the magnets for the tip of a finger or, as illustrated, by securing an annular member 30 on the outer face of the magnets for receiving the end of the user's finger. The strength of the magnet will be determined primarily by the thickness of the resin between the magnet 28 on the external surface of the base 12 and the magnetic or magnetically attractable strip 38 of the figure 26. The magnetic field must be strong enough for to magnetic field to penetrate the base 12 to allow movement of the figure 26 in response to movement of the magnet 28 along the external surface of the base. It will be understood, however, that the support of the figure 26 may itself comprise the magnet and the control element on the exterior of the base member 12 may be a magnetically attractable material.

Although a single magnet 28 may be used in forming the control element 27 for moving the figure 26, the most realistic movement of the figure 26 is achieved when the control element comprises two magnets. It has been found that by the use of two magnets 28 the surfboard will track in a realistic manner as it moves over the upper surface of the base. With two magnets 28 the direction the figure 26 faces is easily controlled to produce a more realistic movement over the upper surface 20 of the base 12. With a single magnet 28, however, the figure 26 can be easily moved but it has a tendency to spin and it is difficult to control the direction that the figure 26 faces making the way it moves unrealistic.

Figure 6:
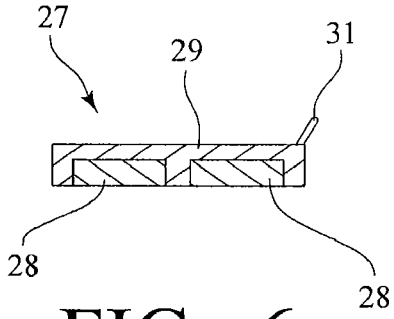
FIG. 6 is a sectional view of a different embodiment in which the magnets are retained in a body.
Figure 4:
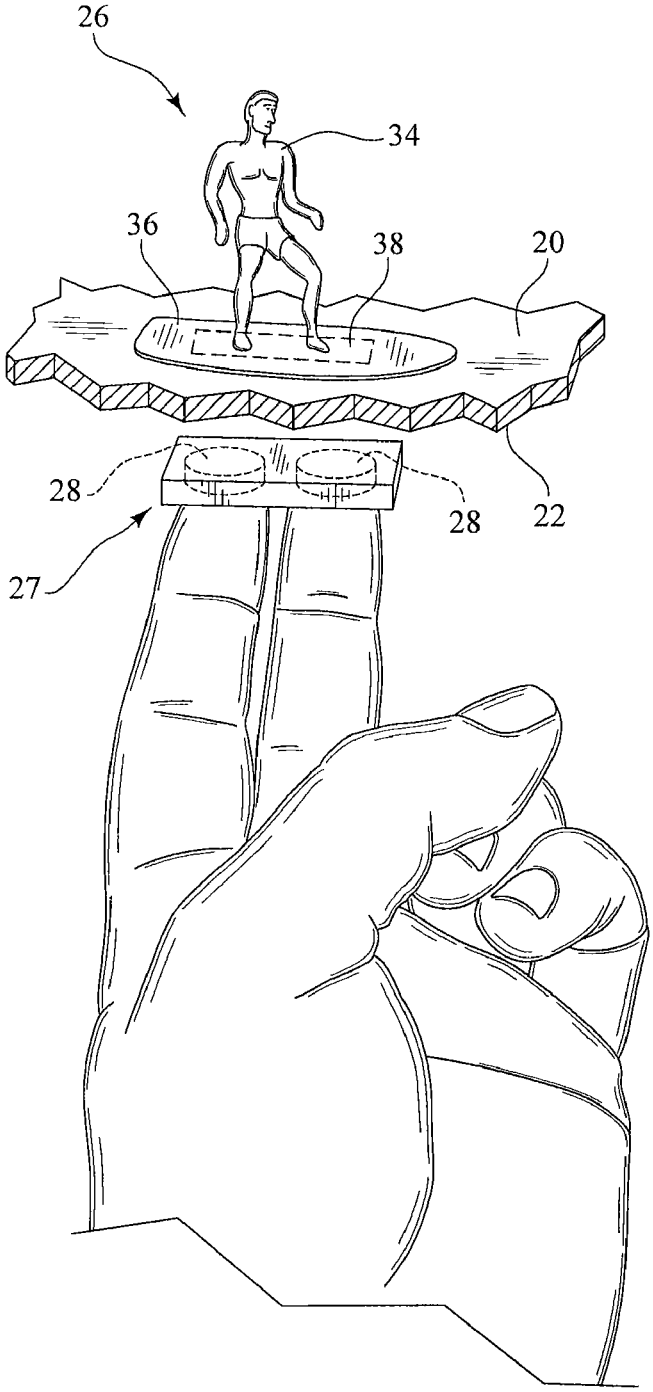
FIG. 4 is a view of the embodiment of FIG. 1, broken away for compactness of illustration, showing a method for moving the figure employing magnets at the exterior of the base member.

In FIGS. 3 and 4 the control element 27 is shown as comprising a pair of individual magnets which are adapted to be moved by the operator's fingers. In some cases it may be preferred that the control element 27 be formed as an integral unit. Referring to FIG. 6 where like reference numbers denote like elements and functions, the control element 27 comprises an integral body 29 in which are supported a pair of the magnets 28. Good results are achieved when the magnets are cast in a suitable resin, such as the resin composition used to form the base 12. For convenience a handle 31 is provided for grasping the control element 27.

To aid in the enjoyment of the miniature scene, an optical viewing device 32 is received in the bore of the cylinder formed by curling portion of the wave.

The optical viewing device 32 comprises a generally cylindrical body (not shown) that includes a wide angle or "fish eye" lens (not shown). These devices are normally utilized to provide a wide-angle view outside of the closed door. Such devices are distributed for example by Direct Door Hardware, Logan, Utah or Quality Plans and Software, Iron Station, N.C.

Figure 2:
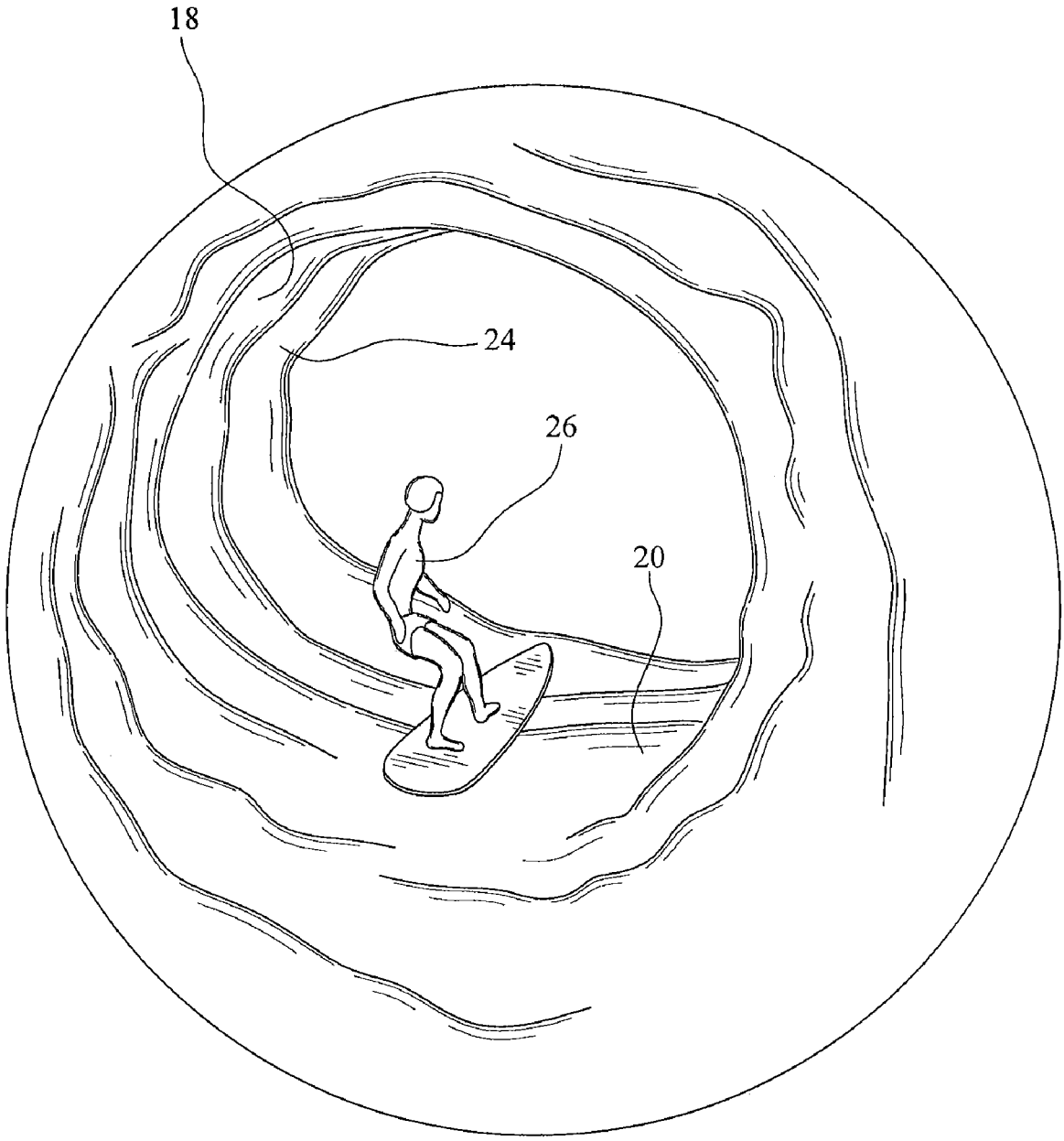
FIG. 2 is a view of the same molded resin sculpture as in FIG. 1, from the "tube" end of the sculpture, showing the view through the fish-eye lens of the surfer and the wave.

FIG. 2 illustrates the view of the scene of FIG. 1 as seen through the viewing device 32. The wide-angle lens allows the observer to view a part of the wave and the figure 26 slightly magnified. The view simulates what would be seen if the observer were inside the curl of the wave. As illustrated in FIG. 3 and FIG. 4, the observer, by sliding the magnets on the outer surface of the base 12, is able to move the figure 26 while observing it through the viewing device 32.

As most clearly shown in FIG. 4, the movable figure 26 comprises an actor form 34 configured to be consistent with the scene. The actor form 34 is secured to a support member 36 that supports the actor form 34 in an upright position on the upper surface 20 of the base 12. A strip 38 of magnetic or magnetically attractable material is secured to the lower surface of the support member 36 and a pair of external magnets 28 are used to move the figure 26 by magnetic attraction between the external magnets and the strip 38 of magnetic or magnetically attractable material as already described in connection with the embodiment of the invention shown in FIG. 1. Preferably, as already explained, the magnets 28 are moved by the observer's fingers. Alternatively, the movable figure 26, especially in the case of a baseball field or football field scene in which the upper surface 20 of the base 12 is essentially level, can be manually placed without the use of magnets.

It will be understood that the scenes presented by the base 12 are not limited to surfing scenes. Thus the base 12 may be configured to illustrate a downhill skiing trail where the figure 26 is configured as a skier or as a skateboard park with the figure 26 configured as a skate boarder.

More elaborate scenes are within the scope of the invention. For example, FIG. 5, where like reference numbers denote like parts and functions, illustrates the base 12 having an upper surface 20 that simulates a baseball field. The end and side faces, 16 and 18, of the base 12 are extended above the upper surface 20 and their inward facing surfaces represent seating for fans in the manner of a baseball stadium. As illustrated, ten figures 26 may be on the field to represent the nine positions taken by the defensive team and the batter who is shown running towards second base. One or more of the figures 26 are movable in the same manner as for the surfing figure 26 discussed above. As illustrated, at least one face of the base 12, the end face 16 nearest home plate is provided with an opening 30 in which is received the optical viewing device 32 of the type described above in connection with the surfing scene. Preferably, each defensive player is movable so that the observer can simulate the various positions the players may take in making a defensive play in response to a hit ball.

In another aspect of the invention the optical viewing device 32 is movable to various locations around the base 12 so that the observer can view the scene from various angles. For example, openings 30 are formed in the side faces 16 of the base 12 in which the optical viewing device 32 can be positioned to allow the observer to view the setting from either side of the field as well as from behind home plate.

As most clearly shown in FIG. 4, the movable figure 26 comprises an actor form 34 configured to be consistent with the scene. The actor form 34 is secured to a support member 36 that supports the actor form 34 in an upright position on the upper surface 20 of the base 12. A strip 38 of magnetic or magnetically attractable material is secured to the lower surface of the support member 36 and a pair of external magnets 28 are used to move the figure 26 by magnetic attraction between the external magnets and the strip 38 of magnetic or magnetically attractable material as already described in connection with the embodiment of the invention shown in FIG. 1. Preferably, as already explained, the magnets 28 are moved by the observer's fingers. Alternatively, the movable figures 26, especially in the case of a baseball field or football field scene in which the upper surface 20 of the base 12 is essentially level, can be manually placed without the use of magnets.

Figure 7:
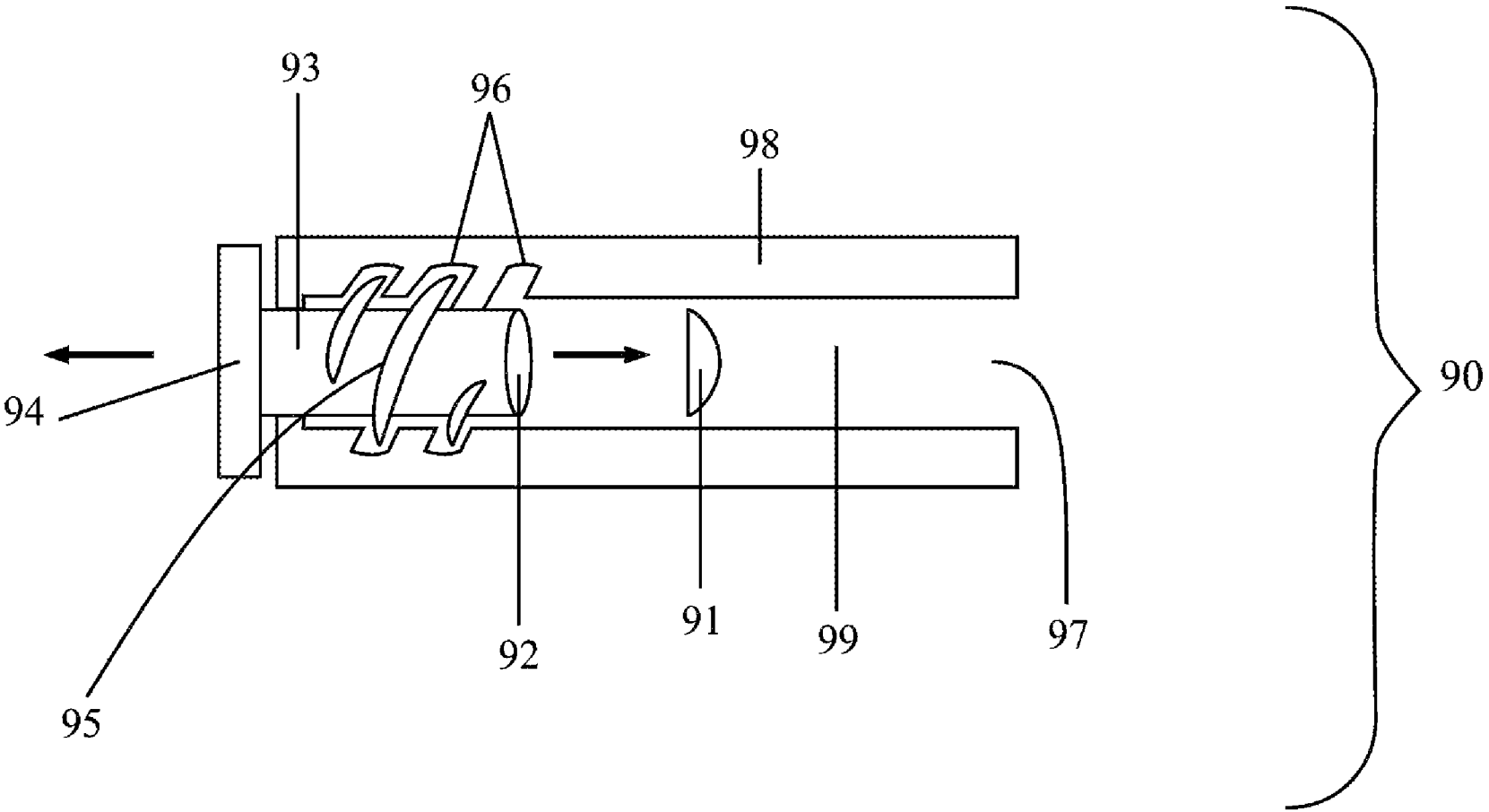
FIG. 7 is a view partially in section and in enlarged scale of the fish-eye lens portion of the sculpture, showing the lens in its magnification mode, in which the lens can be screwed forward and backward along its screw threads to zoom in or zoom out on the surfer.

FIG. 7 is a side view of an embodiment of the fish-eye lens portion of the invention in which the lens component (generally indicated by reference number 90) has a fixed lens (91) and an adjustable lens (92). The adjustable lens (92) is attached to the end of a hollow viewing tube (93) which sits in a lens cavity (99) and is held in place by encasing material (98). The hollow viewing tube (93) has an eyepiece viewer (94) located on the end closest to where a user will view, and screw threads (95) which fit into screw thread cavities (96) built into the encasing material (98). The screw threads (95) turn as the eyepiece viewer (94) is turned, thereby moving the adjustable lens (92) to zoom in or zoom out, as the adjustable lens (92) moves forward and backward, toward the viewer and back toward the distal end (97) of the lens cavity (99).

Figure 8:
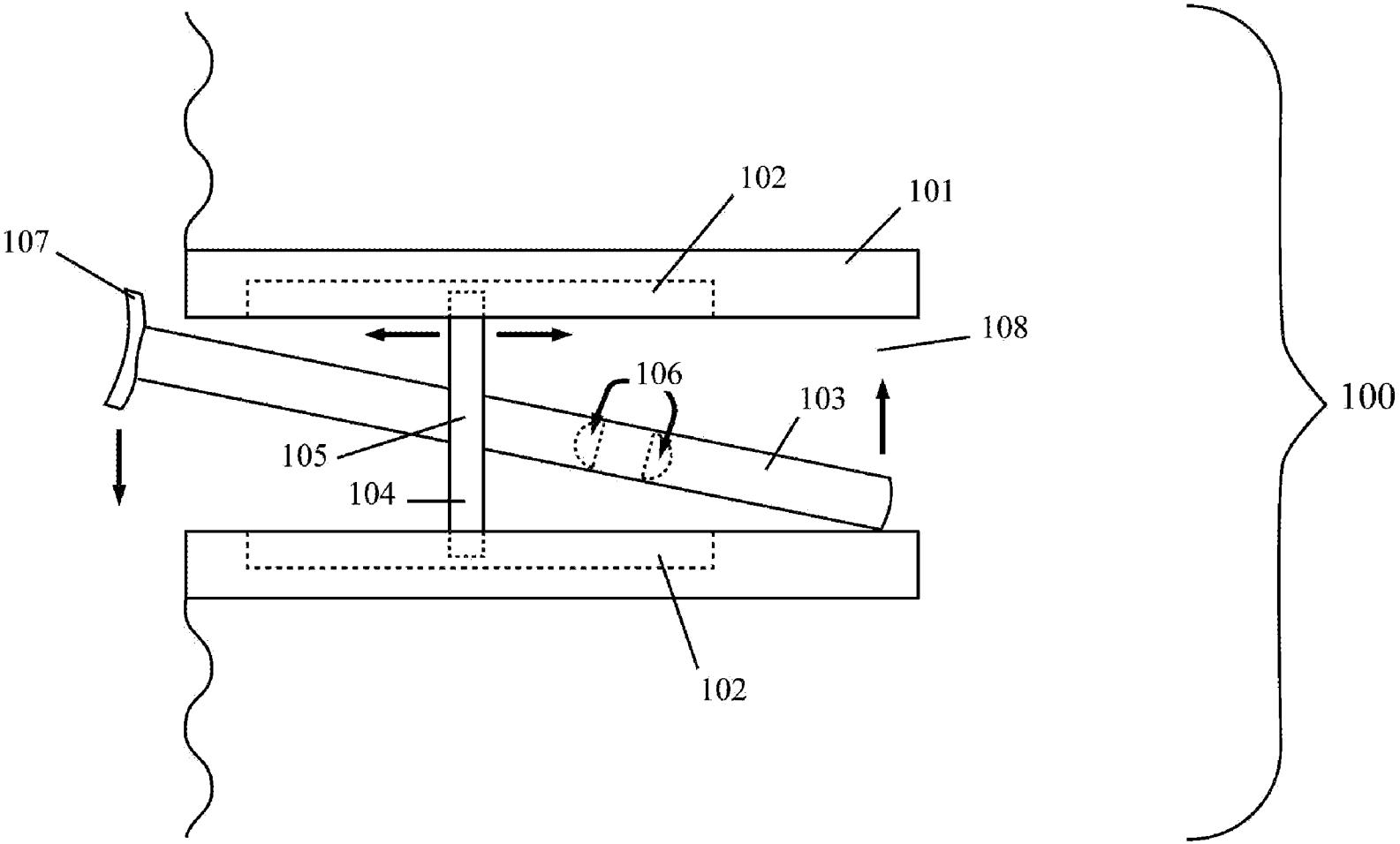
FIG. 8 is a partial, front view of the fish-eye lens portion of the sculpture, showing the lens in its pivot mode, in which the lens can be moved up and down or side to side, to afford a viewer a wide variety of different views of the surfer and the wave.

FIG. 8 is a side view of another embodiment of the fish-eye lens portion of the invention. This embodiment, generally referred to by reference number 100, shows how the hollow viewing tube (103) with its two lenses (106) can move both up and down (vertical arrows show range of movement), as it pivots off a pivot point (105), as well as being slid in either direction (horizontal arrows show direction of movement). The hollow viewing tube (103) is attached to a circular rotating device (104) through a pivot point (105), through which a piece of metal or plastic (not shown in this figure) holds the hollow viewing tube (103) in place. The circular rotating device (104) can be slid in either direction by pushing it or pulling the eyepiece viewer (107), along tracks (102) built into the encasing material (101), and rotated 360 degrees by twisting the eyepiece viewer (107) for leverage. In this embodiment, the user can not only zoom in and zoom out by moving the hollow viewing tube (103) in and out of the lens cavity (108), but also move his/her line of sight in numerous different directions by twisting and moving the hollow viewing tube (103) around the pivot point (105) and rotating the entire circular rotating device (104).

Figure 9:
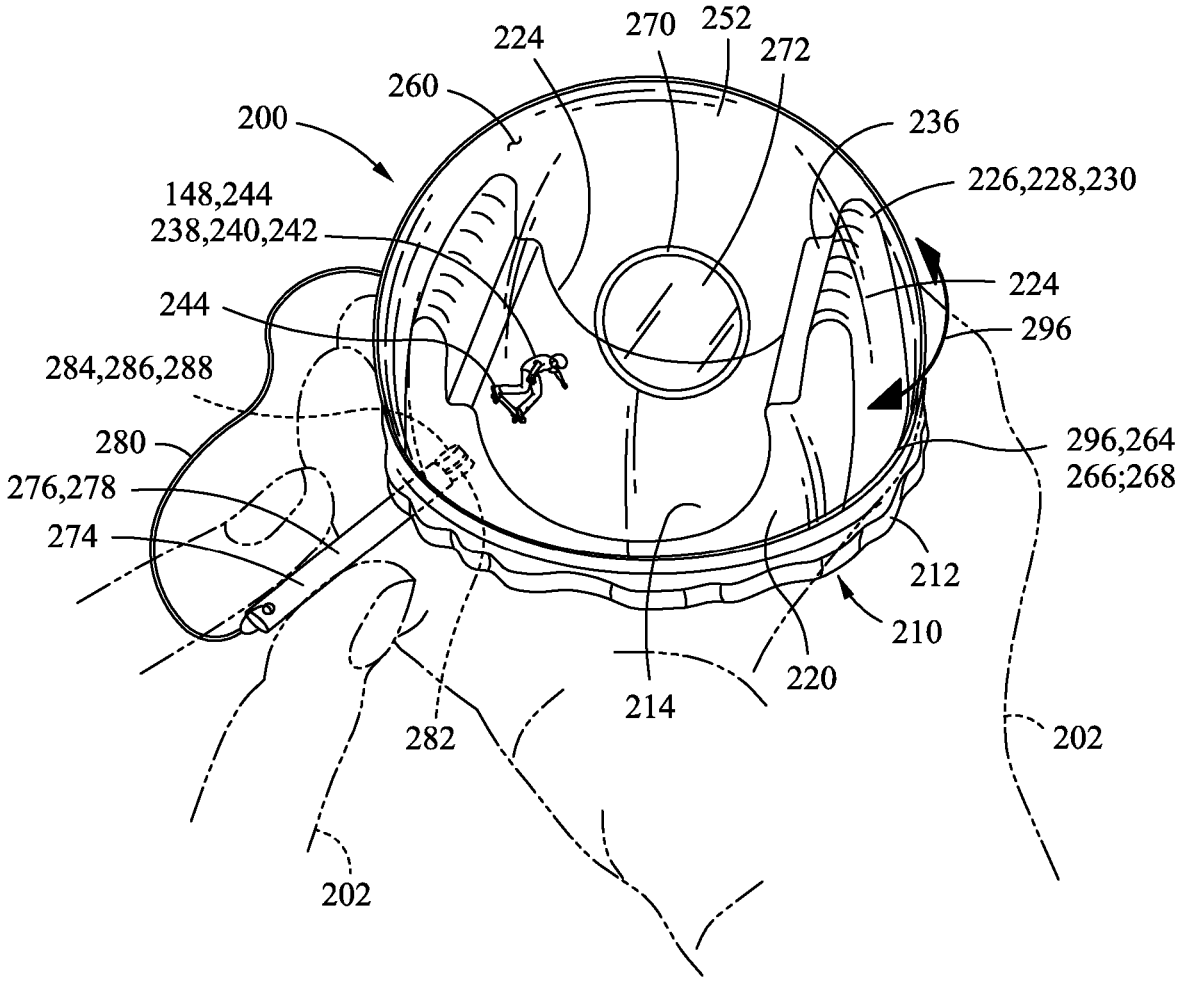
FIG. 9 is a perspective illustration of a sculpture device comprising a base having an upper surface, a figure movable along the upper surface, a cover coupled to the base and a control element for moving the figure along the upper surface and wherein the base is representative of a skateboard ramp comprised of a half pipe portion.

Referring to FIG. 9, shown is an embodiment comprising a sculpture device 200 configured to provide a means for viewing a scene 226 and allowing movement of a figure 248 through the scene 226 by manipulation of a control element 274. As can be seen in FIG. 9, the sculpture device 200 may comprise a base 210 having at least one lower surface 216 and at least one upper surface 214. The sculpture device 200 may further include at least one figure 248 which may be movable along the upper surface 214 by means of the control element 274. The control element 274 may include a magnetic mechanism 284 for magnetically attracting the figure 248 in order to cause the figure 248 to be retained against the upper surface 214 opposite the position of the control element 274 along the lower surface 216. The sculpture device 200 of FIG. 9 may further include a cover 260. The cover 260 may be coupled to the base 210 and, in combination with the upper surface 214, may collectively define a sealed interior 252 for housing the figure 248. In this regard, the cover 260 may prevent loss of the figure 248. The cover 260 may include a lens 272 which may allow an operator 202 to view the figure 248 as the figure 248 is moved along the upper surface 214 by moving the control element 274 along the lower surface 216 in a manner as will be described in greater detail below.

Figure 10:
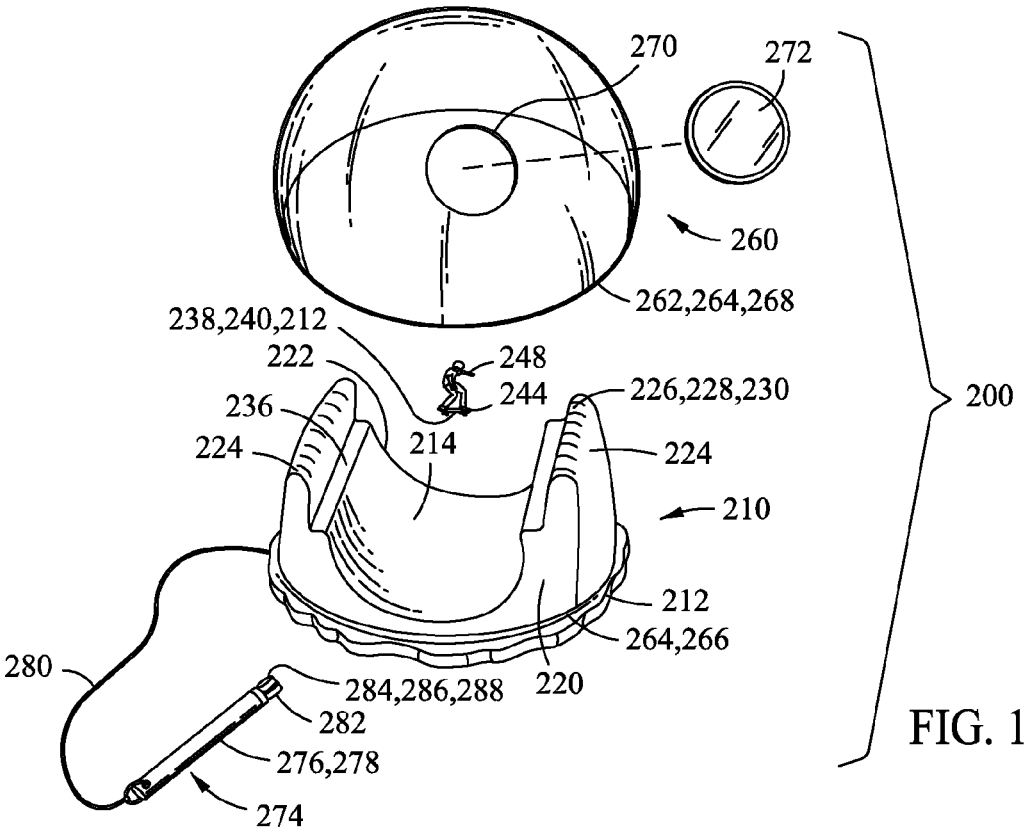
FIG. 10 is an exploded perspective illustration of the sculpture device in an embodiment illustrating the cover having a lens mounted therein and illustrating the figure which may be moved along the upper surface of the base by using the control element.

Referring to FIG. 10, shown is an exploded view of an embodiment of the sculpture device 200 wherein the base 210 may be configured to depict or represent a scene 226 for an activity that may be carried out at the scene 226. The base 210 may include the upper surface 214 which may be configured to represent the scene 226. For example, in FIG. 10, the sculpture device 200 may be configured to represent at least a portion of a skateboard ramp 228. As shown, the upper surface 214 of the base 210 may be configured to represent at least a portion of a skateboard ramp 228. As is known in the art, the skateboard ramp 228 may be configured in a half-pipe 230 configuration wherein the upper surface 214 may further include an opposing pair of platforms 236 upon which the figure 248 may be moved by the control element 274 in order to represent similar movement by a skateboarder on a full-size skateboard ramp 228. The upper surface 214 may further include spectator seating or other features on any one of opposing sides of the upper surface 214.

Referring still to FIG. 10, the sculpture device 200 may further include at least one front face 220 and at least one rear face 222 which may optionally also be configured to represent any one of a variety of scenes 226 including a spectator seating area similar to a seating area that which may be provided at an actual full-size skateboard ramp 228. The sculpture device 200 may further include one or more side faces 224 such as an opposing pair of side faces 224 that may extend from the upper surface 214. One or more of the front, rear and side faces 220, 222, 224 may provide a means for structurally supporting the upper surface 214 relative to the base 210 although the upper surface 214 may be supported in a variety of alternative arrangements. In this regard, the upper surface 214 in conjunction with the side faces 224 and front and rear face 220, 222 may be formed as an integral or unitary structure although the upper surface 214 may be formed as a separate component from the front, rear and/or side faces 220, 222, 224. The front, rear and side faces 220, 222, 224 may extend downwardly to a perimeter edge 212 of the base 210 which, in an embodiment, may define a generally cylindrical shape which may be configured to be complementary to a cylindrical shape of the cover 260 which may be coupled to the base 210 at the perimeter edge 212 of the base 210.

Figure 12:
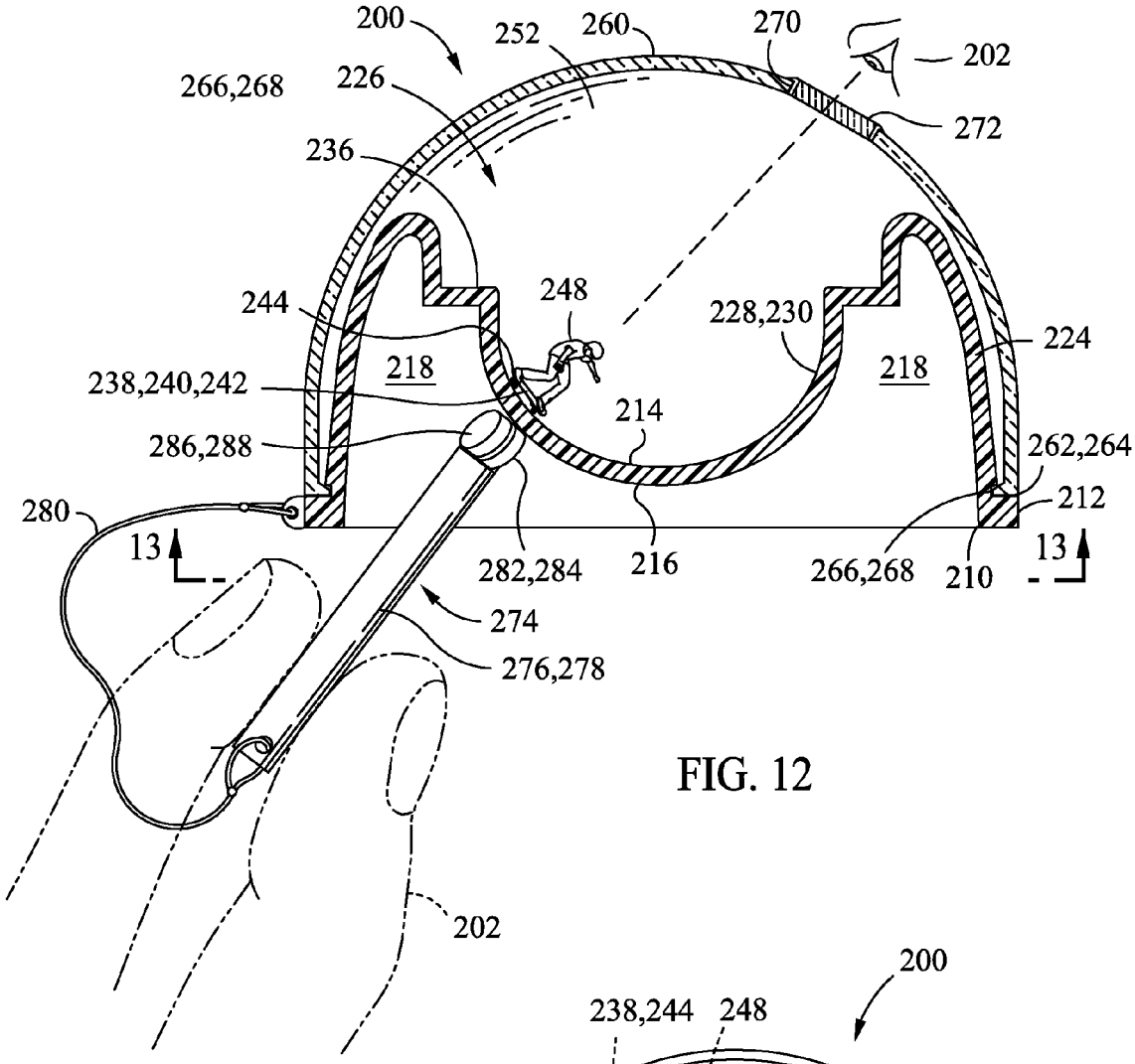
FIG. 12 is a sectional illustration of the sculpture device taken along line 12-12 of FIG. 11 and illustrating the figure which may be caused to be moved by movement of the control element and wherein such movement may be observed by an operator viewing the figure through the lens.

For example, referring briefly to FIG. 12, the cover 260 may be coupled to the base 210 by means of an attachment mechanism 264. In an embodiment, the cover 260 may include a lower edge 262 which may be coupled to the perimeter edge 212 of the base 210. The attachment mechanism 264 may comprise an annular groove 266 which may be formed in the perimeter edge 212 of the base 210. A complementary annular lip 268 may be formed on an interior 252 circumference of the lower edge 262 of the cover 260. However, as may be appreciated, the attachment mechanism 264 may comprise any number of a variety of different configurations for fixedly coupling the cover 260 to the base 210. Preferably, the cover 260 is mated to the base 210 such that the cover 260 may be rotated relative to the base 210 along a cover rotation 296 direction. In this regard, the annular lip 268 formed in the cover 260 may be configured to provide a sliding fit within the annular groove 266 formed in the perimeter edge 212 of the base 210.

Rotation of the cover 260 relative to the base 210 may be facilitated by an operator 202 or user of the sculpture device 200 holding the sculpture device 200 in one hand and rotating the cover 260 along a cover rotation 296 direction using an opposite hand or rotating the cover 260 by automated means or other means. The cover 260 may also be non-rotatably mounted to the base 210. In a further embodiment, a portion of the cover 260 may be rotated relative to a remaining portion of the cover 260. The lens 272 may also be configured to be moved or moved relative to the cover 260 and/or base 210. The attachment mechanism 264 may be provided in a variety of alternative mechanisms as was mentioned above. For example, the annular groove 266 may be formed in the cover 260 and the annular lip 268 may be formed in the base 210. In a preferable embodiment, the cover 260 may be coupled to the base 210 such that the cover 260 is rotatable relative to the base 210 but is retained with the base 210. In this manner, the figure 248 may be maintained within a sealed interior 252 collectively defined by the upper surface 214 of the base 210 and the inner surface of the cover 260.

Referring back to FIG. 10, the cover 260 may include an aperture 270 formed at any location within the cover. The aperture 270 may be sized and configured to receive a lens 272 such as a magnifying lens, a wide angle lens or any one of a variety of lenses or combination of lenses. Furthermore, the cover 260 is not limited to a single lens 272 but may include multiple lenses which may be positioned at any one of a variety of positions on the cover 260. The aperture 270 and/or lens 272 are not limited to a circular shape but may define any one of a variety of shapes. Even further, the lens 272 may be integrally formed with the cover 260 such that the cover 260 and the lens 272 comprise a unitary structure.

Referring still to FIG. 10, the cover 260 may be provided in a substantially transparent configuration. For example, the cover 260 may be formed of any suitable polymeric or glass material which facilitates an observer or operator 202 viewing the interior 252 of the sculpture device 200 at any location on the cover. However, the cover 260 may also include portions which are opaque or non-transparent such that viewing of the interior 252 of the sculpture device 200 is limited or prevented. For example, it is contemplated that a lower portion of the cover 260 may be substantially opaque or non-transparent and the upper portions of the cover 260 including the lens 272 may be substantially transparent. The cover 260 may be provided in any suitable shape. For example, the cover 260 may have a hemispherical or a dome-like shape. In an embodiment, the cover 260 may have a shape that is complementary to a shape of the upper surface 214 of the base 210.

For example, as shown in FIG. 12, the cover 260 may have a shape which is complementary to the shape and configuration of the side faces 224 which support the upper surface 214. In an embodiment, the cover 260 may be configured to minimize the spacing or gap between the cover 260 and the front, rear and/or side faces 224 to prevent entrapment of the figure 248 in the spacing between the cover 260 and front, rear and/or side faces 220, 222, 224. In an embodiment, the cover 260 may be provided as a generally flattened dome having a cylindrical lower portion such that the cover 260 may be rotatably moved relative to the base 210 along a cover rotation 296 direction. Referring still to FIG. 10, the sculpture device 200 can be seen as including the control element 274 which, in an embodiment, may be tethered to the base 210 by means of a tether 280. The tether 280 may comprise a connecting element of any suitable configuration such as a relatively thin but high strength string or line element which is preferably flexible and which prevents separation of the control element 274 from the base 210. In this regard, the tether 280 may prevent misplacement or loss of the control element 274.

Figure 11:
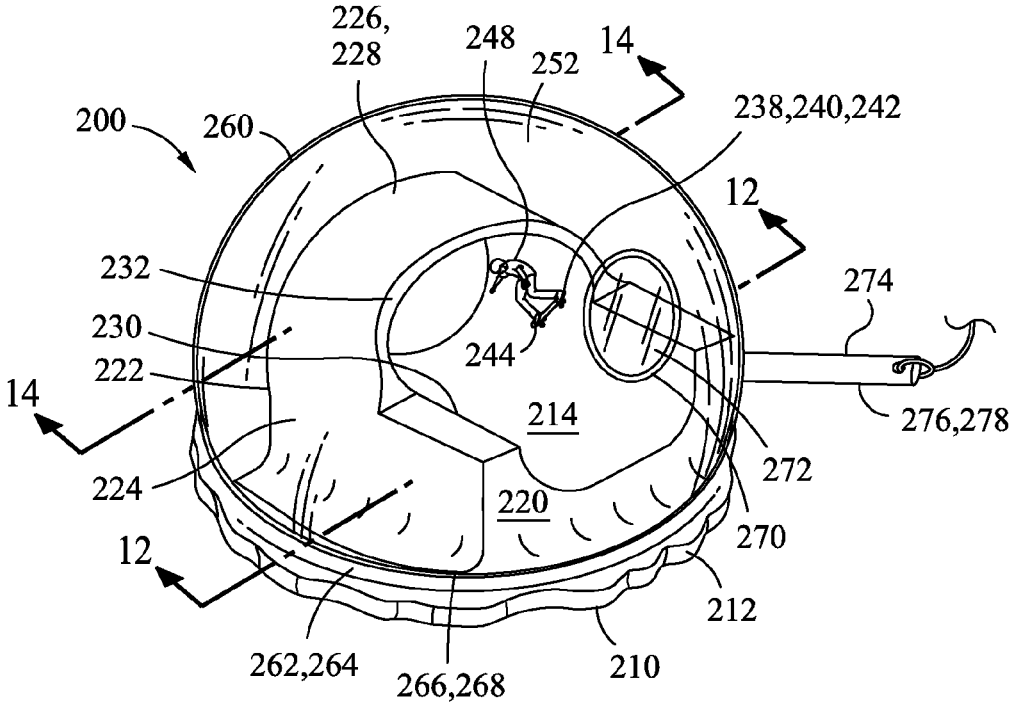
FIG. 11 is a perspective illustration of the sculpture device in an embodiment wherein the upper surface of the base is representative of a skateboard ramp comprised of a half pipe portion and a full pipe portion.

Referring briefly to FIG. 11, shown is an embodiment of the sculpture device 200 wherein the base 210 is configured to represent a skateboard ramp 228. In this regard, the skateboard ramp 228 configuration of FIG. 11 is similar to the skateboard ramp 228 configuration of FIGS. 9 and 10 with the addition of a full-pipe 232 portion which may be integrally formed with a half-pipe 230 portion of the base 210 as shown.

As may be appreciated, the base 210 configuration may be configured to represent a variety of different scenes 226 for carrying out a variety of different activities as previously indicated. In one or more of the configurations of the sculpture device, the control element 274 may be configured to cause the figure 248 to be moved along one or more portions of the upper surface 214. In an additional embodiment, the control element 274 may be configured to control the orientation or tracking of the figure 248 as the figure 248 is moved along the upper surface 214. In such a configuration, the control element 274 may comprise a magnetic mechanism 284 including at least two magnets which may be aligned in a desired orientation in order to cause a corresponding realignment or reorientation of the figure 248 in a manner as is described in greater detail below.

Referring more particularly to FIG. 12, shown is a sectional illustration of the sculpture device 200 illustrating the control element 274 for controlling movement of the figure 248. As can be seen in FIG. 12, the base 210 may be formed in such a manner that the lower surface 216 defines a hollowed area or cavity 218 within which the control element 274 may be moved to allow movement of the magnetic mechanism 284 along the lower surface 216. As described above, such movement may facilitate movement of the figure 248 along the upper surface 214 in a desired direction. The magnetic mechanism 284 may also cause the figure 248 to be retained against the upper surface 214 of the base 210. In this regard, the magnetic mechanism 284 may create a magnetic field which may attract the figure 248 to the control element, or vice versa. Therefore, by moving the control element, the figure 248 can be caused to move in a corresponding manner.

Preferably, the magnetic mechanism 284 is sized and configured to generate a sufficient magnetic field to attract the figure 248 and retain the figure 248 against the upper surface 214 at the location of the control element 274. As can be seen in FIG. 12, the control element 274 is configured such that movement of the control element 274 along the lower surface 216 causes a corresponding movement of the figure 248 along the upper surface 214 to a corresponding position of the figure 248 on the upper surface 214. In an embodiment, the magnetic mechanism 284 may comprise one or more magnets mounted to the control element 274. The figure 248 may include magnetically attractable material 242 mounted to the figure 248. Conversely, the magnetic mechanism 284 may comprise at least one magnet mounted to the figure 248 and magnetically attractable material 242 mounted to the control element 274. The base 210 is preferably formed of non-magnetic material in order to avoid interference with the magnetic attraction between the control element 274 and the figure 248. However, the base 210 may be formed of any material.

Referring still to FIG. 12, shown is an embodiment of the control element 274 configured as an elongate shaft 276. At least a portion of the shaft 276 of the control element 274 may be ergonomically shaped and sized to facilitate grasping thereof by an operator's 202 fingers and/or hand. For example, the control element 274 may include a handle 278. Although shown as an elongate shaft, the control element 274 may be configured in any suitable configuration for controlling movement of the figure 248. For example, the control element 274 may be configured similar to that which is illustrated in FIG. 4 wherein the control element 274 may be adapted to be worn on one or more of the operator's 202 fingers. Additionally, the control element 274 is preferably of a size which allows an operator 202 to move the figure 248 to any one of a variety of positions along the upper surface 214 including positions that are remote from the perimeter edge 212 of the base. For example, the control element 274 is preferably of a sufficient length to enable the operator 202 to guide the figure 248 up toward the upper platforms 236 located on opposing sides of the skateboard ramp 228 in the configuration shown in FIG. 12. The control element 274 may include a free end 282 upon which the magnetic mechanism 284 may be mounted. The magnetic mechanism 284 may comprise one or more magnets or magnetically attractable material 242 which may be mounted or attached to the free end 282 of the shaft 276 by any suitable means. For example, the one or more magnets may be adhesively bonded or mechanically fixed to the free end 282 of the control element 274 or shaft 276. In an alternative embodiment, the control element 274 may be molded to contain the one or more magnets or magnetically attractable material 242. The magnets or magnetically attractable material 242 may optionally be press-fit into the free end 282 of the control element 274.

As may be appreciated, the control element 274 may be provided in a wide variety of sizes, shapes and configurations and is not limited to the elongate shaft 276 illustrated in FIG. 12 and/or the configuration for mounting on the operator's fingers shown in FIG. 4. For example, the control element 274 may comprise a generally long handle 278 for grasping within a palm of the operator's hand. The control element 274 is not limited to a generally straight configuration but may further include any number of bends, pivots or hinges formed at one or more locations along the length of the control element 274 such that the control element 274 may be adjusted to fit within the narrower confines of the cavity 218 such that the figure 248 may be moved to remote locations along the upper surface 214 of the base 210.

Figure 13:
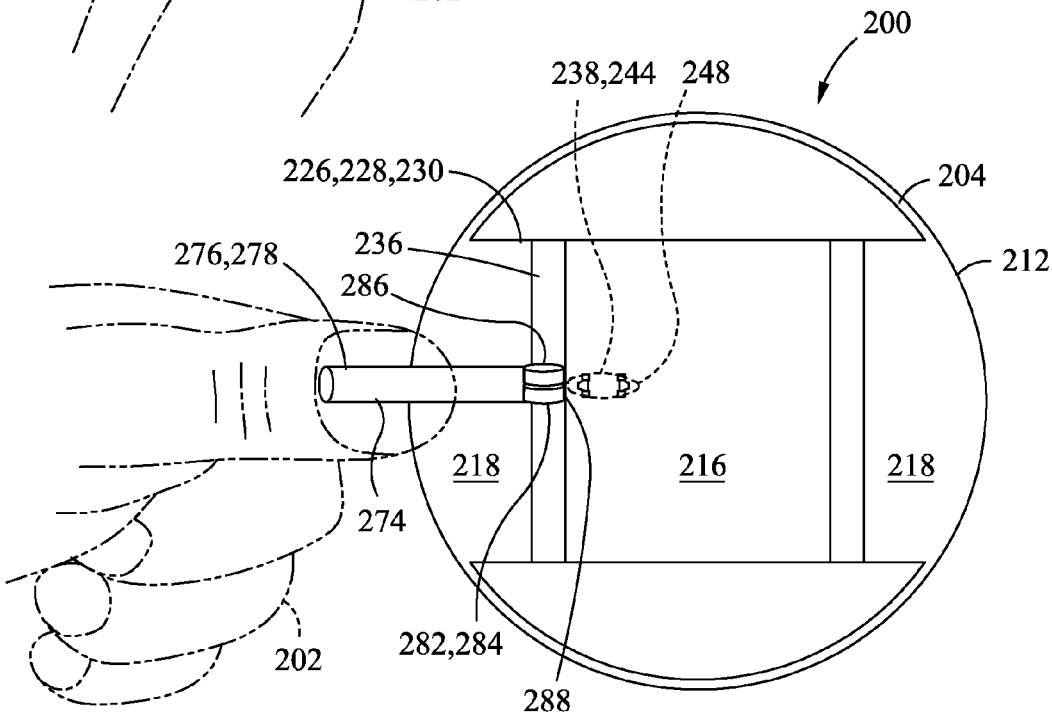
FIG. 13 is a bottom illustration of the sculpture device taken along line 13-13 of FIG. 12 and illustrating an operator grasping and moving the control element along the lower surface such that the figure may be moved along the upper surface.

Referring briefly to FIG. 13, shown is a bottom view of the sculpture device 200 illustrating a configuration of the lower surface 216. As can be seen in FIG. 13, the lower surface 216 may generally mirror the shape and configuration of the upper surface 214 such that magnetic attraction may be maintained between the control element 274 and the figure 248 as the figure 248 is moved along the lower surface 216. The control element 274 may be moved along the lower surface 216 to portions of the cavity 218 where the control element 274 may have access. However, the figure 248 may also be moved to areas along the upper surface 214 that may not be accessible by the control element 274 at a corresponding location along the lower surface 216. As may be appreciated, the base 210 may be provided in a variety of shapes, sizes and configurations.

Figure 14:
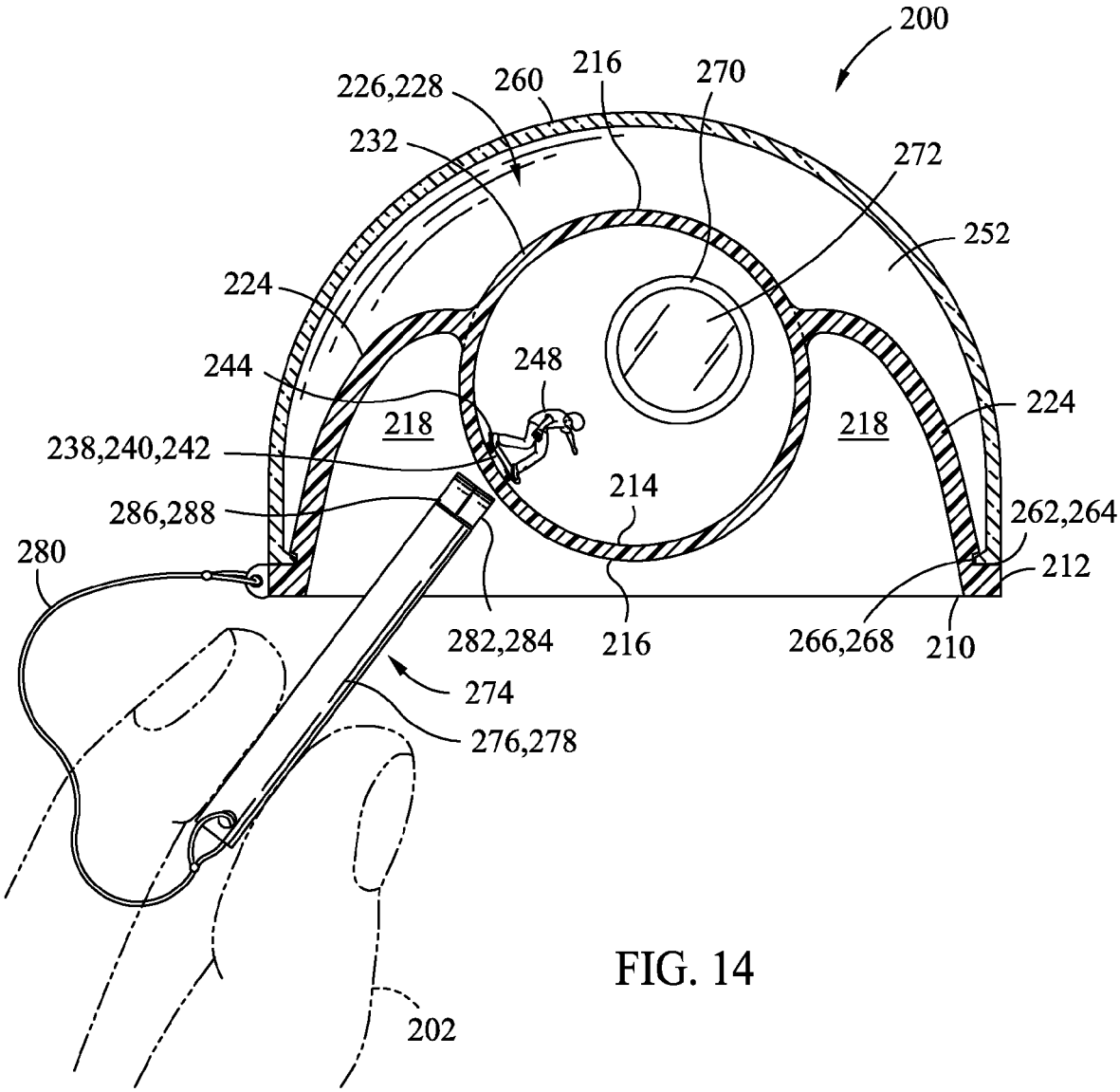
FIG. 14 is a sectional illustration of the sculpture device taken along line 14-14 of FIG. 11 and illustrating a full pipe portion of the skateboard ramp.

Referring to FIG. 14, shown is a cross-sectional illustration of the sculpture device 200 taken along line 14-14 of FIG. 11 and illustrating the transition of the base 210 from the cross-sectional illustration of FIG. 12 wherein the sculpture device 200 forms a half-pipe 230 configuration of a skateboard ramp 228 to a full-pipe 232 configuration of the skateboard ramp 228 of FIG. 12. The sculpture device 200 includes the lens 272 which may be incorporated into the cover 260 and through which an operator 202 may observe or view the figure 248 as the figure 248 is moved within the base 210 as a result of movement of the control element 274.

Figure 15:
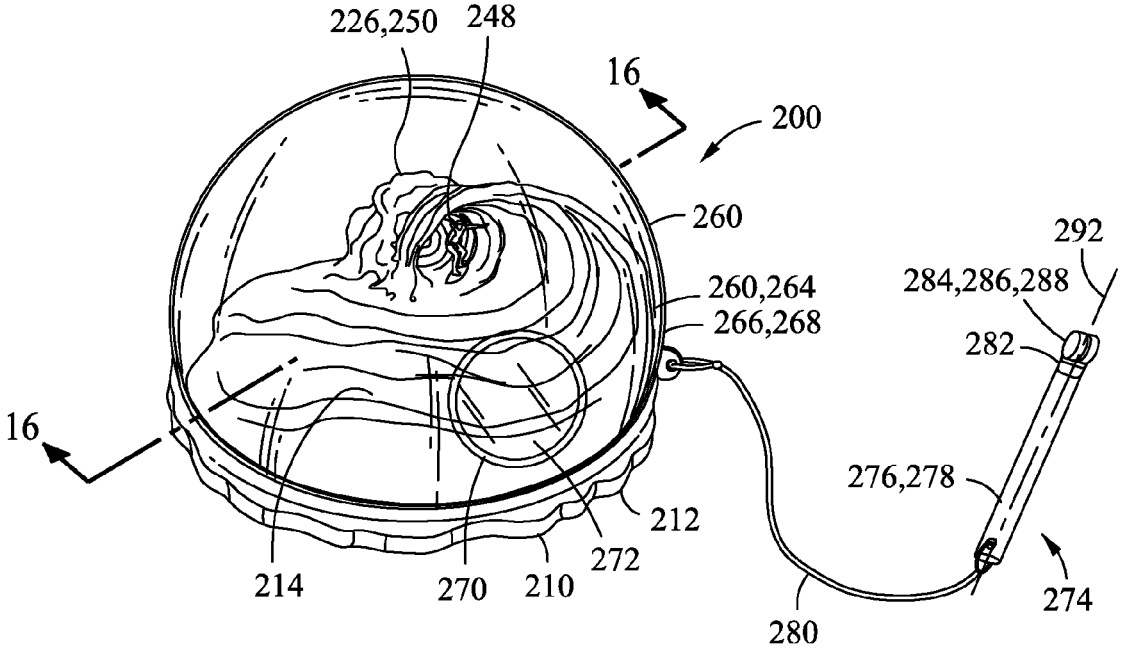
FIG. 15 is a perspective illustration of the sculpture device wherein the upper surface is configured to represent a wave and the figure is configured to represent an individual on a surfboard wherein the control element may facilitate movement of the figure along the upper surface.

Referring to FIG. 15, shown is an embodiment of the sculpture device 200 wherein the base 210 includes the upper surface 214 configured to represent a wave 250 and the figure 248 is configured to represent an individual riding a surfboard 246. As can be seen, the lens 272 provides a means by which an operator 202 may view the figure 248 such as during movement of the figure 248 along the upper surface 214 representing the wave. In this regard the figure 248 may be moved in a manner that is representative of movement of an actual surfer within a wave 250 due to movement of the control element 274 by the operator. The operator 202 may manipulate movement of the figure 248 within the sculpture device 200 as shown in FIG. 15 by moving the magnetic mechanism 284 in close proximity or in contacting relation to the lower surface 216.

Figure 16:
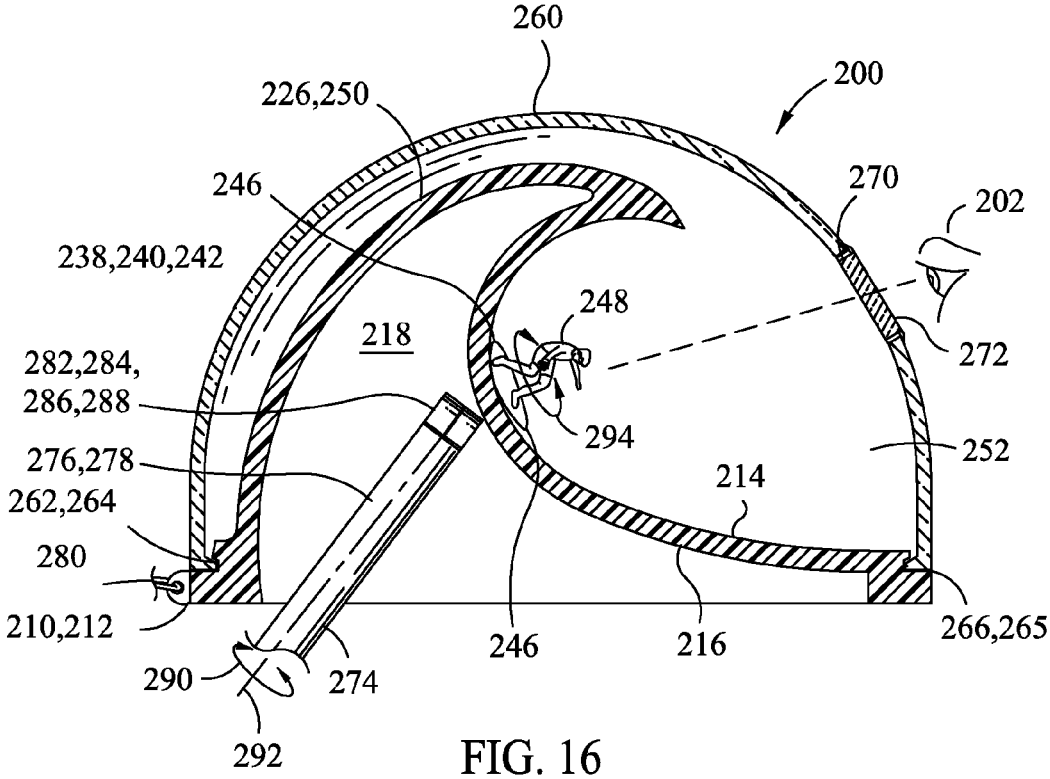
FIG. 16 is a sectional illustration of the sculpture device taken along line 16-16 of FIG. 15 and illustrating the control element disposed against the lower surface for causing movement of the figure along the upper surface and further illustrating the operator viewing the figure through the lens.

For example, and referring to FIG. 16, the control element 274 is shown disposed against the lower surface 216. Due to magnetic attraction between the control element 274 and the figure 248, the movement of the control element 274 causes corresponding movement of the figure 248 along the upper surface 214. In this regard, the operator 202 may move the figure 248 to any one of a variety of desired positions along the upper surface 214 such as along a surface of the wave 250 represented by the base 210 in FIGS. 15 and 16.

Figure 17:
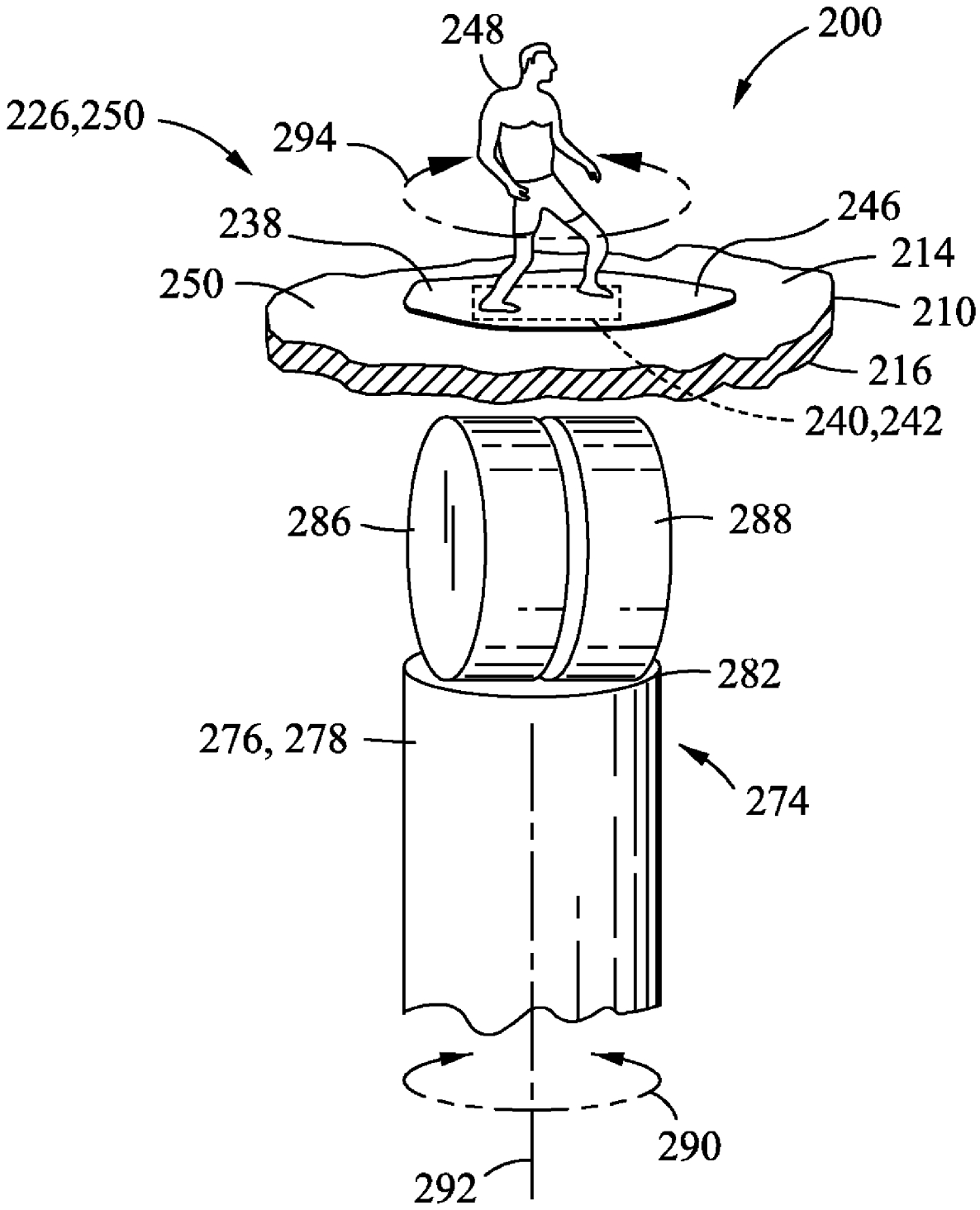
FIG. 17 is an exploded illustration of the magnetic mechanism in an embodiment mounted on an end of the control element comprising first and second magnets mounted in a manner for controlling an orientation of the figure.

Referring to FIG. 17, shown is the figure 248 which may be mounted on a support member 238. In the embodiment illustrated in FIG. 17, the support member 238 may comprise a model of a surfboard 246 or any other suitable device that is compatible with the scene 226 within which the particular activity is being carried out. The figure 248 may be fixedly coupled to the support member 238. The figure 248 and/or support member 238 may include one or more magnets. Alternatively, the figure 248 and/or support member 238 may include magnetically attractable material 242. The magnetically attractable material 242 may be formed in one or more strips 240 although the magnetically attractable material 242 may be formed in any one of a variety of shapes and sizes and in any quantity.

The strip 240 of magnetically attractable material 242 may be mounted to or within the figure 248 and/or support member 238. The control element 274 may comprise one or more magnets such as the first and second magnets 286, 288 which may be mounted in side-by-side relation as shown in FIG. 17. By mounting the first and second magnets 286, 288 in the manner shown, the control element 274 provides a means by which the orientation of the figure 248 may be controlled as the figure 248 such as when the figure 248 is moved along the upper surface 214. For example, in the embodiment shown in FIG. 17, the control element 274 may define a longitudinal axis 292 about which the control element 274 may be rotated along a control element orientation direction 290 and causing corresponding rotation of the first and second magnets 286, 288 which are fixedly coupled to the control element 274 at the free end 282. Due to alignment of the first and second magnets 286, 288 which may preferably, but optionally, be disposed in side-by-side relation to one another, the figure 248 may likewise be reoriented in correspondence with the orientation of the control element 274 along a figure orientation direction 294. In this regard, the first and second magnets 286, 288 preferably generate one or more magnetic fields in a manner to facilitate directional or orientational control of the support member 238 and/or figure 248 mounted on the support member 238. The magnetic field is preferably of a sufficient strength to facilitate control of the orientation of the figure 248 regardless of the thickness of the base 210.

Alternatively, the first and second magnets may be configured similar to that which is shown in FIG. 4 wherein the magnets may be mounted on the operator's fingers such that movement of the operator's fingers causes corresponding movement and reorientation of the figure. It should be noted that although the control element illustrates the magnetic mechanism as comprising a pair of magnets disposed in side-by-side relationship similar to that which is illustrated in FIG. 17, the magnetic mechanism 284 may comprise one or more magnets mounted in any suitable orientation on the control element 274. Further in this regard, the magnetic mechanism 284 may comprise the first and second magnets 286, 288 oriented at 90 degrees relative to that which is shown in FIG. 17. In this regard, the magnetic mechanism 284 may comprise one or more magnets which may be of any size, shape or configuration and is not limited to the cylindrical disk-shaped configuration shown in FIG. 17. Furthermore, the magnetic mechanism 284 may comprise one or more magnets wherein the magnets are oriented in alignment with the longitudinal axis 292 as shown in FIGS. 18-19 as opposed to the edge-wise mounting of the first and second magnets 286, 288 on the free end 282 of the control element 274 as shown in FIG. 17.

Figure 18:
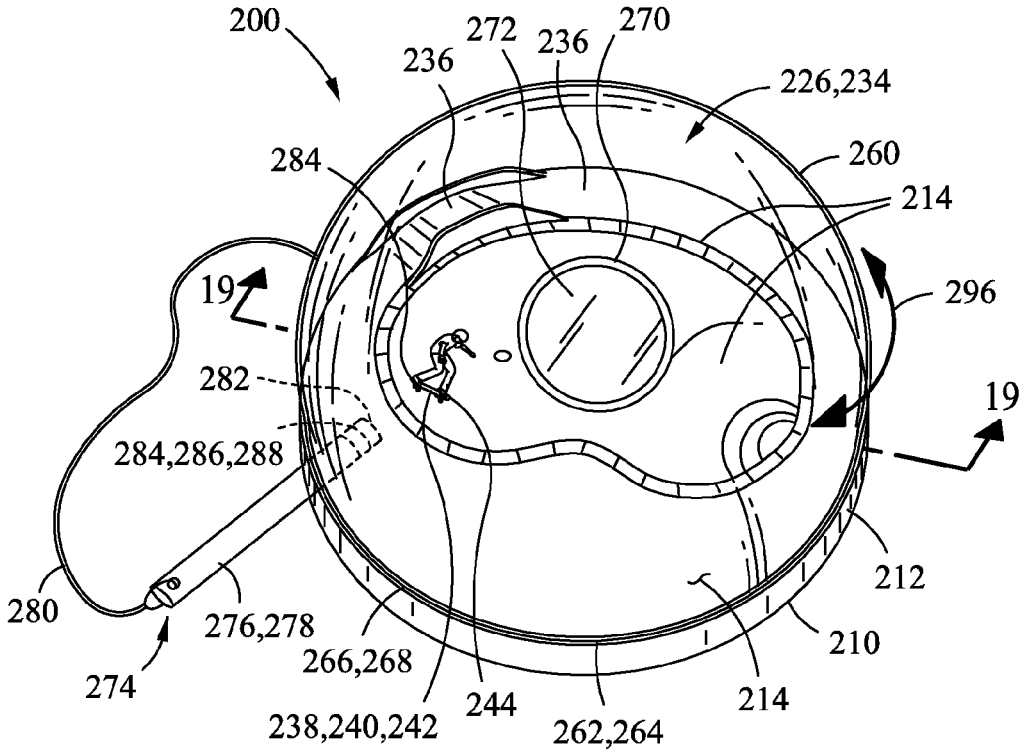
FIG. 18 is a perspective illustration of the sculpture device wherein the upper surface is representative of a skateboard park and the figure is configured to represent an individual on the skateboard.

Referring briefly to FIG. 18, shown is the base 210 wherein the upper surface 214 is configured to represent at least a portion of a skateboard park 234. In an embodiment, the upper surface 214 of the skateboard park 234 may include a relatively smooth finish having a variety of surface features over which the figure 248 may be moved by manipulation of the control element 274. Movement of the figure 248 with regard to the upper surface 214 may be viewed by an operator 202 looking through the cover 260 or by looking through the lens 272 which may be configured as a magnifying lens, a wide angle lens or any one of a variety of lens configuration or combinations of lens configurations. The cover 260 may optionally be rotatable relative to the base 210 along a cover rotation 296 direction to allow viewing of the figure 248 and/or upper surface 214 through the lens 272 from a variety of different vantage points.

Figure 19:
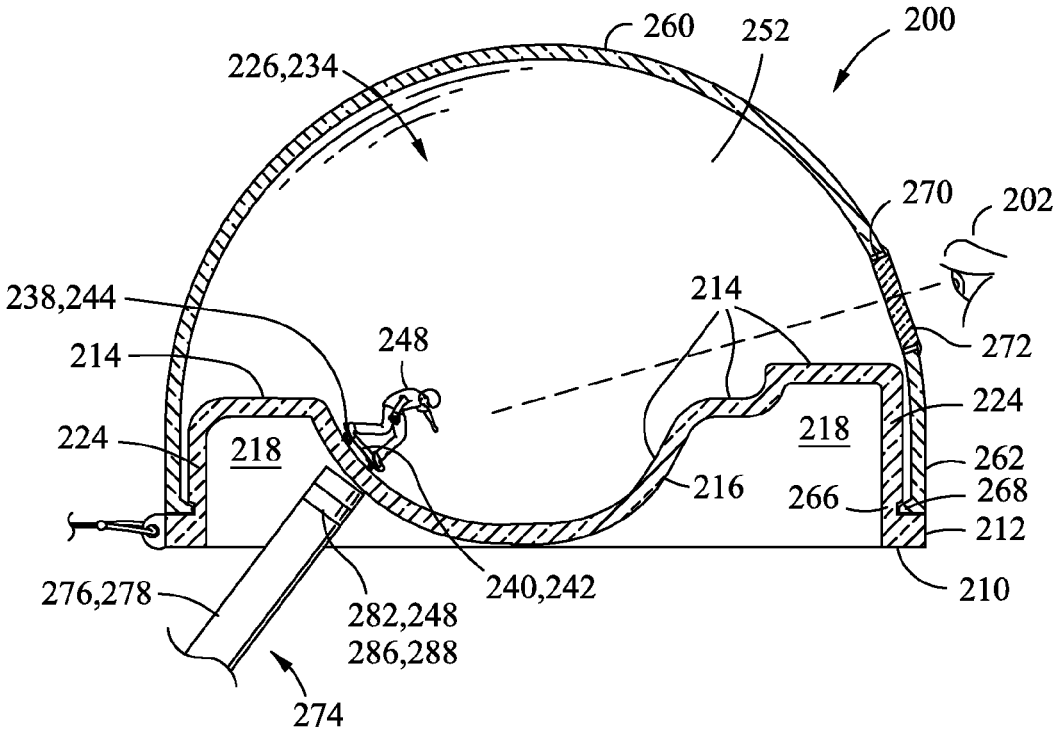
FIG. 19 is a sectional illustration of the sculpture device taken along line 19-19 of FIG. 18 and illustrating the control element disposed along the lower surface for retaining the figure at a corresponding position along the upper surface.

Referring briefly to FIG. 19, shown is a sectional illustration taken along line 19-19 of FIG. 18 and further illustrating the control element 274 being disposed against the lower surface 216 for magnetically attracting and retaining the figure 248 against the upper surface 214. The base 210 may include platforms 236 disposed on opposing sides which the figure 248 may be moved along or positioned relative thereto. Manipulation or rotation of the control element 274 such as by rotating the shaft 276 about the longitudinal axis 292 may result in corresponding rotation or orientation of the figure. Such orientation may be achieved by including magnetically attractable material 242 or a pair of the magnets which may be mounted in a manner similar to that which is shown with reference to FIG. 17 as described above. Although FIG. 19 illustrates the magnetic mechanism 284 comprising the first and second magnets 286, 288, the magnetic mechanism 284 may be provided as a single magnet for attracting and retaining the figure 248 against the upper surface 214.

In this regard, for certain embodiments of the sculpture device 200, the control element 274 may include one or more magnets mounted in a manner such that rotational or orientational movement of the figure 248 may be unrestricted. For example, an individual riding a skateboard 244 may spin or rotate with a greater degree of freedom as compared to the generally more controlled movement of an individual riding a surfboard 246. Therefore, in simulating such movement of a skateboard 244, it may be desirable to provide the control element 274 with one or more magnets as shown in FIGS. 18-19 to allow free rotational movement of the skateboard 244 as the skateboard 244 is moved along the upper surface 214. Optionally, the support member 238 and/or figure 248 may be provided with one or more magnets arranged in such a manner to facilitate free rotational movement of the figure 248 regardless of the orientation of the control element 274. For example, the support member 238 and/or figure 248 may include one or magnets arranged as shown in FIGS. 18-19.

Conversely, and referring to FIGS. 15-16, in simulating more controlled movement of figure 248 such as, without limitation, a surfboard 246 on a wave, the control element 274 may be provided with a means to control the tracking or orientation of the figure 248 as the figure 248 is moved along the upper surface 214. In this regard, the control element 274 may include the first and second magnets 286, 288 as shown in FIG. 17. Optionally, the support member 238 and/or figure 248 may include first and second magnets 286, 288 in an orientation similar to that which is shown in FIG. 17. In such an arrangement, the control element 247 may include a strip 240 of magnetically attractable material 242 to facilitate controlled orientation of the figure 248. In this regard, the control element 274 and figure 248/support member 238 may be configured in any suitable arrangement to provide a means to simulate maneuvers that may be performed by a surfer. Such maneuvers may include, but are not limited to, bottom turns, cutbacks, floaters, re-entries, off-the-lips and a variety of other maneuvers that may be reproduced by controlling the orientational movement of the figure 248 by rotating the control element 274 about the longitudinal axis 292.

Although the sculpture device 200 is described with regard to the figure 248 representing individuals such as an individual on a surfboard 246 or a skateboard 244, it should be recognized that the sculpture device 200 may be configured to depict a variety of different scenes for a variety of different activities that may be carried out at the scene including any number of figures. For example, the base may be configured with an upper surface that may represent a stadium or an athletic field. The base may include one or more front, rear and side faces which may collectively or separately represent a spectator seating area of the stadium or athletic field or any other portion of the scene representing an athletic field. In this regard, the spectator seating area may be formed to surround and/or extend above the upper surface.

Figure 5:
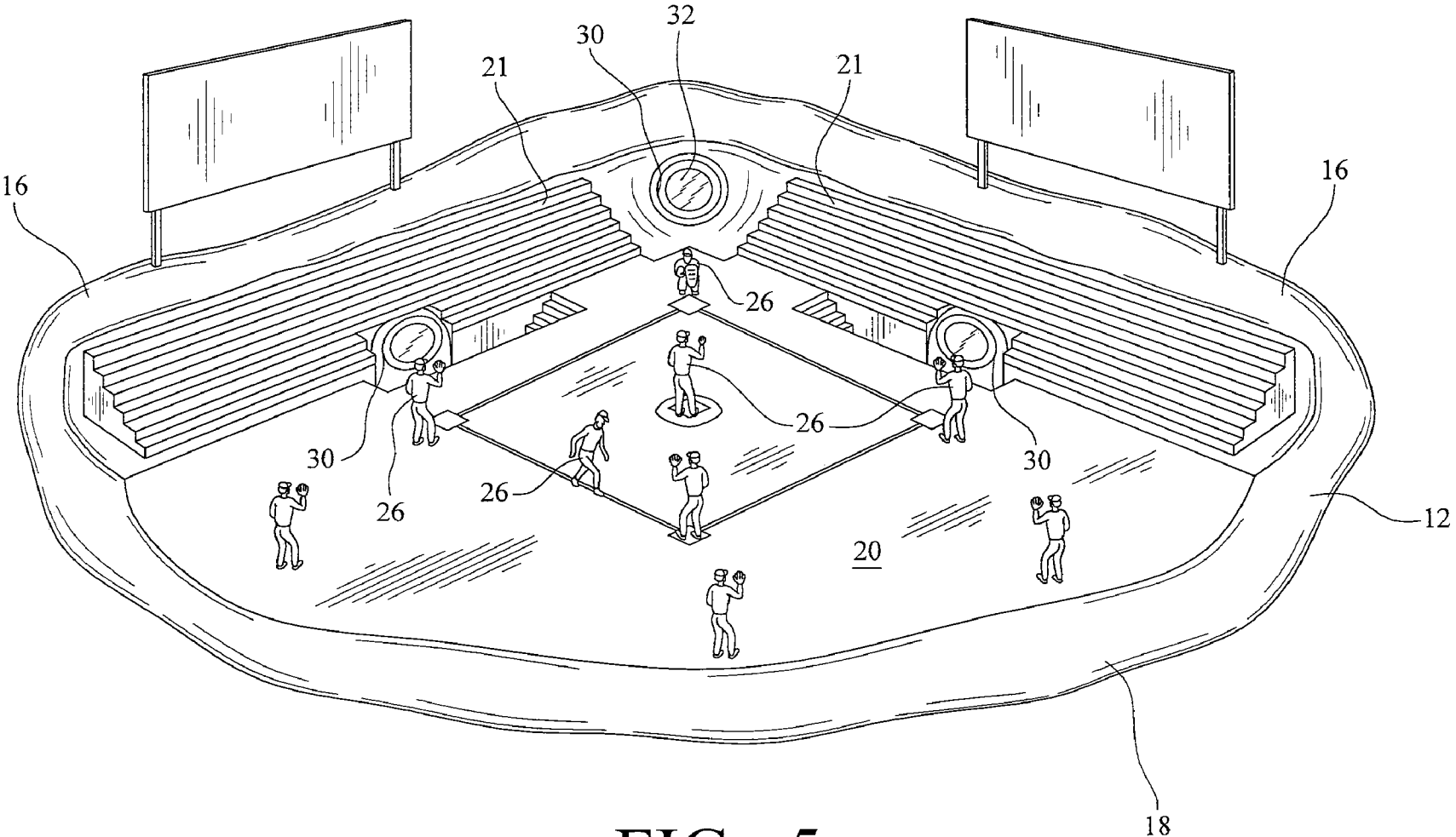
FIG. 5 is a view from the front end of the base illustrating another embodiment of the invention where the scene is a baseball park.

For example, referring to FIG. 5, the upper surface 20 may be configured to represent a baseball field wherein the figures 26 may represent a plurality of baseball players that are movably positionable at various locations on the field in response to movement of one or more control elements (not shown) along the lower or bottom surface 22. The control elements may be similar to that which is illustrated in FIGS. 3 and 9-19 and may be movable along the bottom surface 22 such that the figures 22 may be moved along the upper surface 20 in order to depict movement that may represent an actual baseball game. The base 12 may include an opening 30 formed in one or more locations along the base 12 as shown in FIG. 5. The opening 30 may include an optical viewing device 32 as described above. The opening may optionally include a lens 272 similar to that which is illustrated in FIGS. 9-19.

Optionally, the base 12 may include a cover (not shown in FIG. 5) that may be provided over the base similar to the arrangement shown in FIGS. 9-19. The cover may include one or more lenses as also shown in FIGS. 9-19. Each one of the lenses may be configured as the optical viewing device 32 described above and/or as a magnifying lens or a wide angle lens through which an operator may view the figures 26 and/or the upper surface 20. The cover may be rotatably coupled to the base 12 in a manner as was described above with regard to the base 210 configurations shown in FIGS. 9-19. The cover may also be non-rotatably fixed relative to the base 12. As may be appreciated, the figures 26 may be provided in any one of a variety of different configurations to simulate any activity including, but not limited to, sporting activities.

As can been seen, the sculpture device 200 may be configured to represent an infinite variety of settings or scenes. Likewise, the figure(s) may be configured in an infinite variety of embodiments representing an infinite variety of activities that may be carried out at the scene and is not limited to an embodiment of the skateboard and surfboard illustrated in the figures. For example, the figure may be configured to represent a snowboarder on a snowboard and the upper surface of the base may be configured to represent a terrain park with various hits, rails and obstacles similar to those which are found at a ski resort. The figure may further be configured to represent a BMX rider on a BMX bicycle and the upper surface of the base may be configured to represent a skateboard ramp or skateboard park or any other setting that may be used by a BMX bicycle rider. As can be seen, the figure may be configured to represent any one of an infinite variety of individuals or devices that may be used in an infinite variety of settings that may be represented by the sculpture device.

As will be understood by those skilled in the art, various arrangements which lie within the spirit and scope of the invention other than those described in detail in the specification will occur to those persons skilled in the art. It is therefore to be understood that the invention is to be limited only by the claims appended hereto. Additional modifications and improvements of the present invention may also be apparent to those of ordinary skill in the art. Thus, the particular combination of parts described and illustrated herein is intended to represent only certain embodiments of the present invention and is not intended to serve as limitations of alternative devices or functionalities within the spirit and scope of the invention.

What is claimed is:

1. A sculpture device, comprising:

a base having a lower surface and an upper surface;

at least one figure movable along the upper surface;

a cover coupled to the base and having at least one lens mounted thereto; and a control element having a magnetic mechanism for magnetically attracting the figure and causing the figure to be retained against the upper surface opposite a position of the control element on the lower surface, the control element being configured such that movement thereof along the lower surface causes corresponding movement of the figure to a corresponding position on the upper surface.

2. The sculpture device of claim 1 wherein the magnetic mechanism comprises at least one of a magnet and magnetically attractable material mounted to at least one of the figure and the control element.

3. The sculpture device of claim 1 wherein the figure includes a support member having a strip of the magnetically attractable material mounted thereto.

4. The sculpture device of claim 1 wherein the cover and upper surface collectively form a sealed interior.

5. The sculpture device of claim 1 wherein the lens is configured as at least one of a magnifying lens and a wide-angle lens.

6. The sculpture device of claim 1 wherein the cover is rotatably coupled to the base.

7. The sculpture device of claim 1 wherein at least a portion of the cover is substantially transparent.

8. The sculpture device of claim 1 wherein the cover has a hemispherical shape.

9. The sculpture device of claim 1 wherein the control element comprises an elongate shaft having the magnetic mechanism mounted thereon.

10. The sculpture device of claim 1 wherein the control element is tethered to the base.

11. The sculpture device of claim 1 wherein the control element is adapted to be worn on an operator's finger.

12. The sculpture device of claim 1 wherein:

the magnetic mechanism comprises a pair of magnets mounted to at least one of the control element and the figure, the magnetic mechanism being mounted in a manner for controlling an orientation of the figure as the figure is moved along the upper surface as a result of movement of the control element along the lower surface.

13. The sculpture device of claim 12 wherein:

the control element is configured as an elongate shaft having a free end and defining a longitudinal axis;

the magnetic mechanism comprising first and second magnets mounted on the free end in a manner such that rotation of the shaft about the longitudinal axis results in a change in the orientation of the figure.

14. The sculpture device of claim 1 wherein:

the upper surface is configured to represent a wave;

the figure is configured to represent an individual on a surfboard.

15. The sculpture device of claim 1 wherein:

the upper surface of the base is configured to represent at least a portion of at least one of a skateboard park and a skateboard ramp;

the figure being configured to represent an individual on a skateboard.

16. The sculpture device of claim 1 wherein:

the upper surface is configured to represent one of a stadium and an athletic field;

the figure comprising a plurality of figures being movable along the upper surface in response to movement of the control element along the lower surface.

17. A sculpture device depicting a scene for an activity that may be carried out at the scene, comprising:

a base having a lower surface and an upper surface, the upper surface being configured to represent the scene for an activity carried out at the scene;

at least one figure including magnetically attractable material, the figure being movable along the upper surface; and a control element configured as an elongate shaft having first and second magnets mounted thereto for magnetically attracting the figure and causing the figure to be retained against the upper surface opposite a position of the control element on the lower surface, the control element being configured such that movement thereof along the lower surface causes corresponding movement of the figure along the upper surface, the first and second magnets being mounted in a manner for controlling an orientation of the figure as the figure is moved along the upper surface as a result of movement of the control element along the lower surface; and a cover rotatably coupled to the base and having a magnifying lens mounted therein and through which an operator may view the figure during movement thereof along the upper surface.

18. The sculpture device of claim 17 wherein at least a portion of the cover is substantially transparent.

19. The sculpture device of claim 17 wherein:

the upper surface is configured to represent a wave;

the figure is configured to represent an individual on a surfboard.

20. The sculpture device of claim 17 wherein:

the upper surface of the base is configured to represent at least a portion of at least one of a skateboard park and a skateboard ramp;

the figure being configured to represent an individual on a skateboard.

* * * * *